US005885158A

United States Patent [19]

Torango et al.

[11] Patent Number: 5,885,158

[45] Date of Patent: Mar. 23, 1999

[54] GAMING SYSTEM FOR MULTIPLE PROGRESSIVE GAMES

[75] Inventors: Lawrence J. Torango; Kumar Kannan; Mark Lowell; Bhavani Prasad; Wayne Seguin; Rick Rowe; Adrian Marcu, all of Reno, Nev.

[73] Assignee: International Game Technology, Reno, Nev.

[21] Appl. No.: 716,823

[22] Filed: Sep. 10, 1996

Related U.S. Application Data

[60] Provisional application No. 60/600,670, Feb. 13, 1996.

[51] Int. Cl. [6] ..... A63F 9/24

[52] U.S. Cl. ..... 463/27

[58] Field of Search ..... 463/20, 21, 26, 463/27, 29, 40, 42

[56] References Cited

U.S. PATENT DOCUMENTS

| | | | |
|---|---|---|---|
| 4,837,728 | 6/1989 | Barrie et al. | 364/412 |
| 4,964,638 | 10/1990 | Ishida | 273/138 A |
| 5,116,055 | 5/1992 | Tracy | 273/138 A |
| 5,249,800 | 10/1993 | Hilgendorf et al. | 463/27 |
| 5,344,144 | 9/1994 | Canon | 463/27 |
| 5,472,194 | 12/1995 | Breeding et al. | 463/29 |
| 5,564,700 | 10/1996 | Celona | 463/20 |
| 5,611,730 | 3/1997 | Weiss | 463/20 |

FOREIGN PATENT DOCUMENTS

| | | | |
|---|---|---|---|
| 567001 | 7/1986 | Australia | G07F 17/34 |
| 589158 | 8/1986 | Australia | G07F 17/34 |
| 593059 | 8/1987 | Australia | G07F 17/34 |
| 585160 | 1/1988 | Australia | G07F 17/34 |
| 630112 | 3/1990 | Australia | G07F 17/34 |
| 655801 | 9/1992 | Australia | G07F 17/34 |

*Primary Examiner*—George Manuel
*Attorney, Agent, or Firm*—Sheridan Ross P.C.

[57] ABSTRACT

A progressive gaming system is configured to run many progressive prizes on one central system. The relationship between progressive group and prize with a particular game is designed so that the odds and bet on a particular game need not be identical throughout a group. In one embodiment, prize definition is in terms of number of coins expected to be played between prize hits, independent of denomination, and minimum number of coins returned to players, regardless of odds or denominations. When a progressive game is designed, the coins bet and odds related to the logic of the game are verified as compatible with the prize definitions coins expected to be played between prize hits. The prize definition is used to validate an association between a particular game and a particular progressive prize. Preferably the event that triggers a progressive prize may be unrelated to the events on any game.

30 Claims, 18 Drawing Sheets

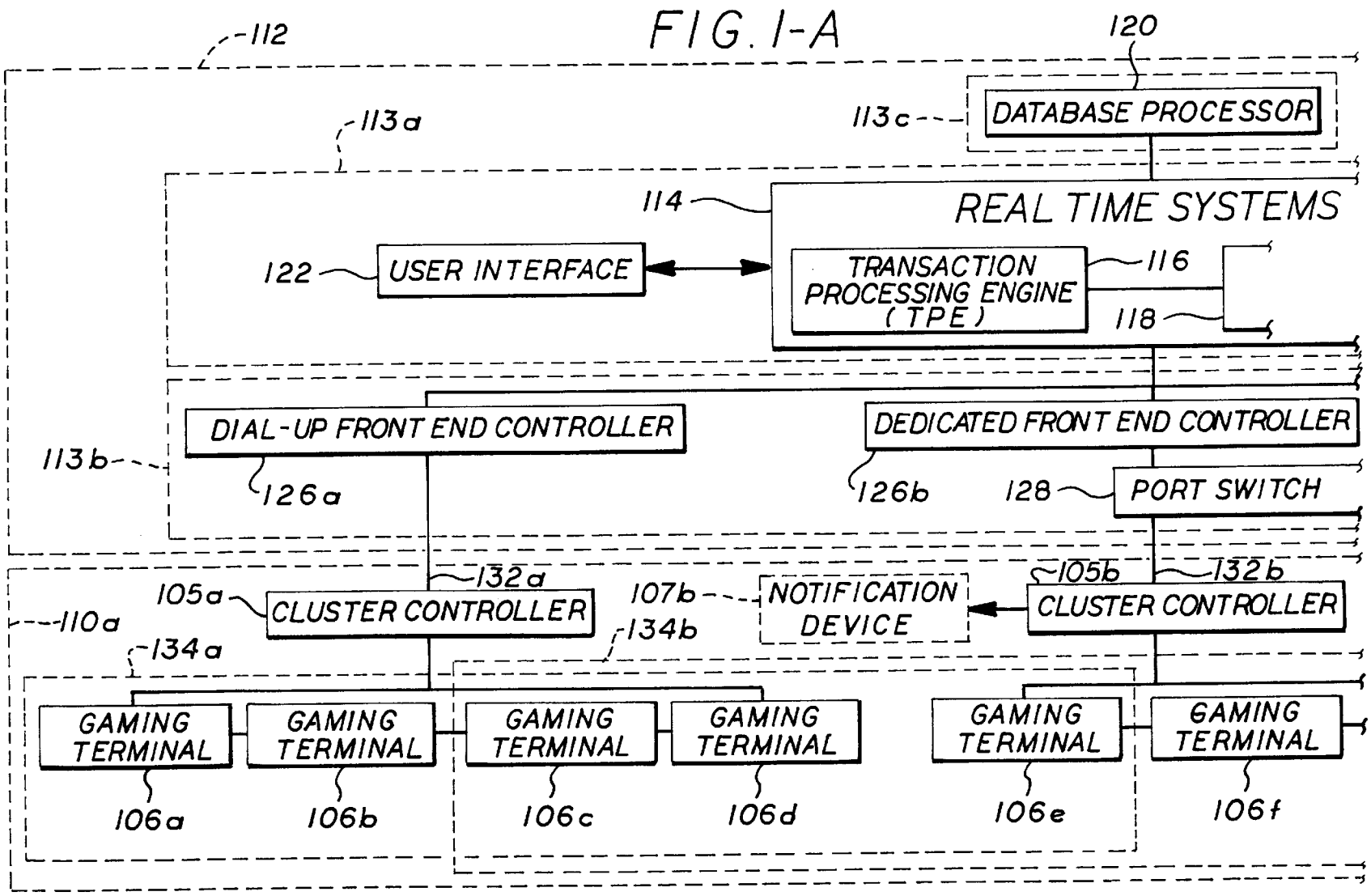
FIG. 1-A

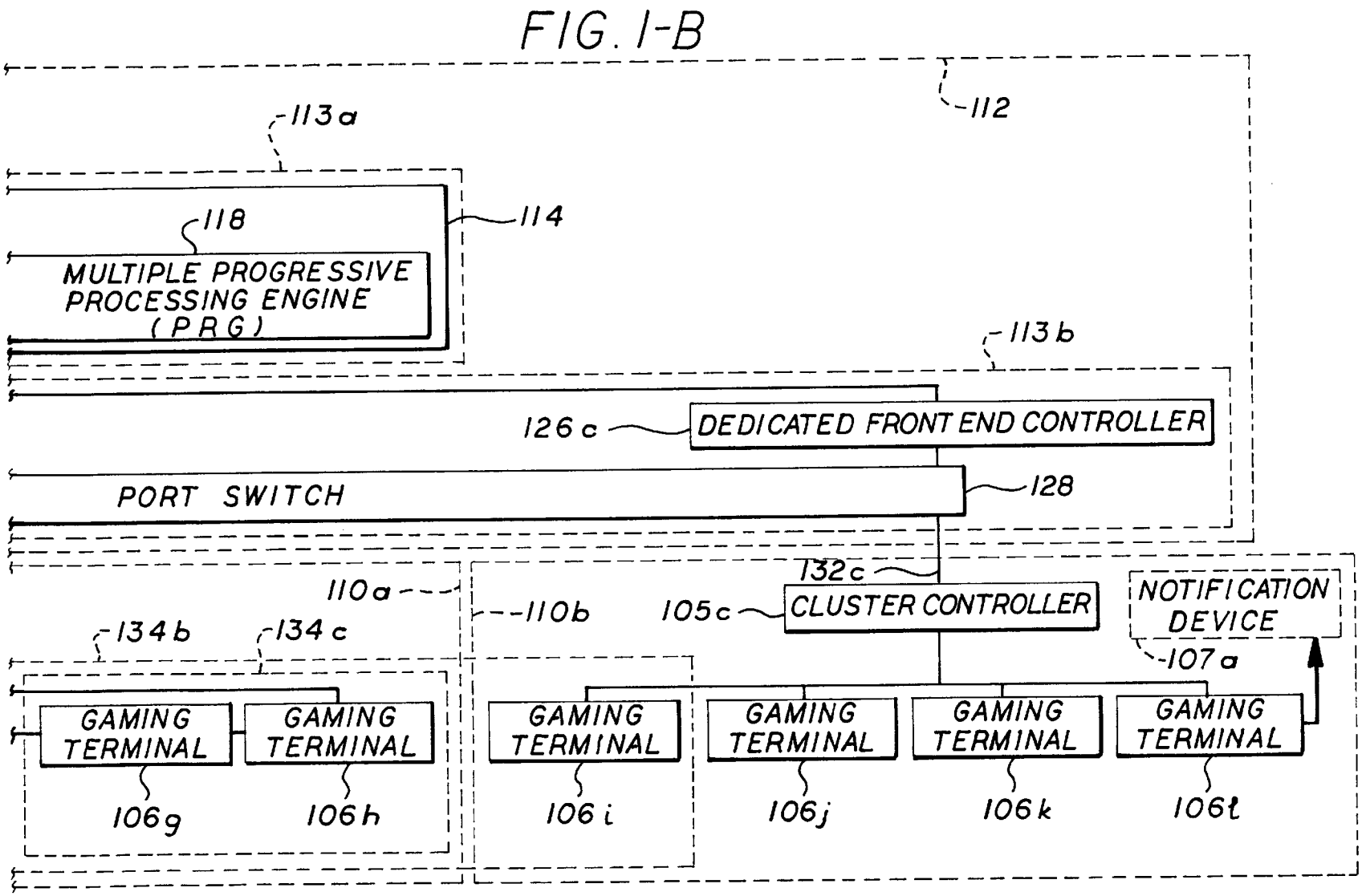
FIG. 1-B

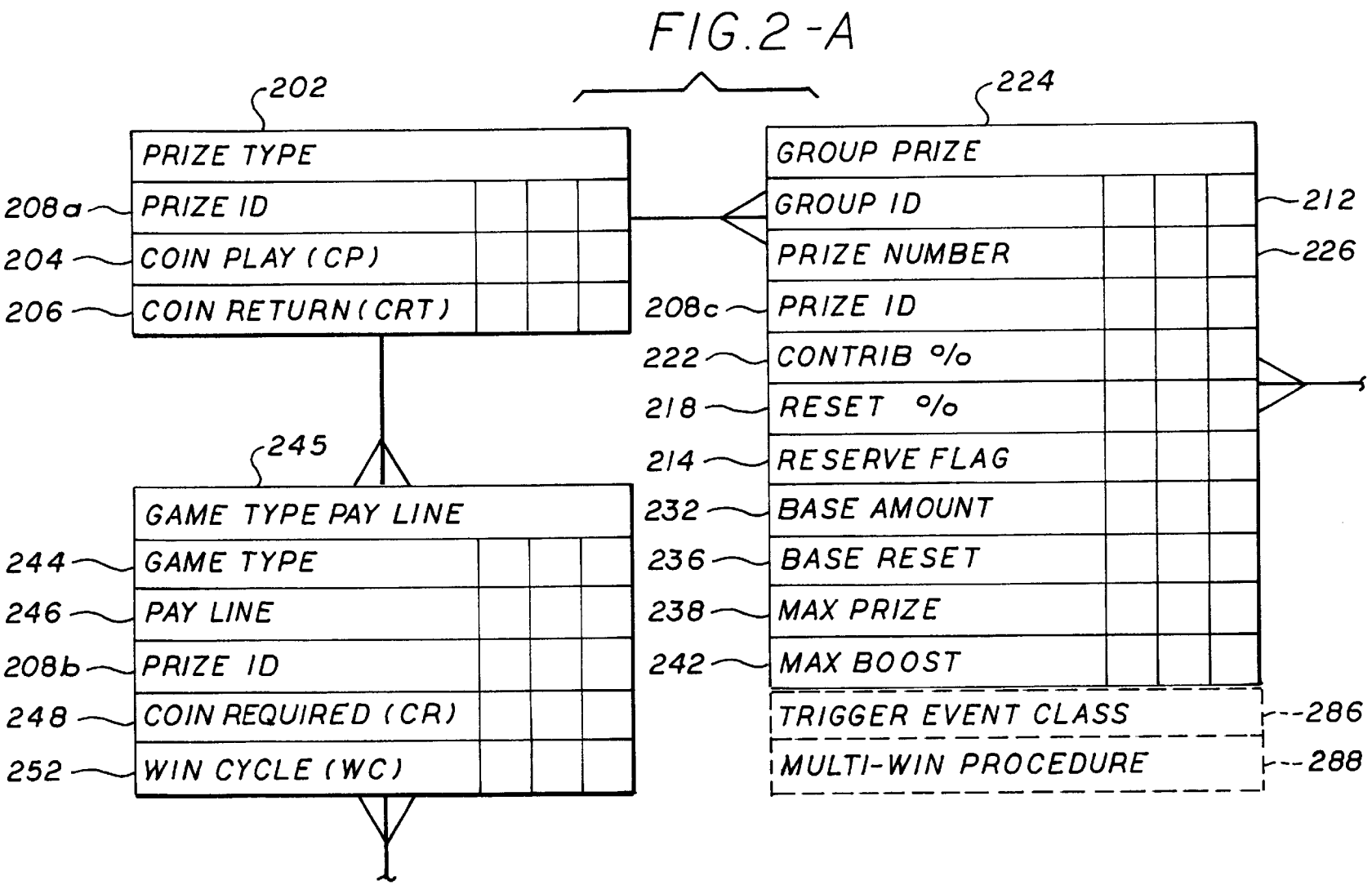
FIG. 2-A
224
GROUP PRIZE
GROUP ID
PRIZE NUMBER
PRIZE ID
CONTRIB %
RESET %
RESERVE FLAG
BASE AMOUNT
BASE RESET
MAX PRIZE
MAX BOOST
TRIGGER EVENT CLASS
MULTI-WIN PROCEDURE
212
226
286
288
208c
222
218
214
232
236
238
242
202
PRIZE TYPE
PRIZE ID
COIN PLAY (CP)
COIN RETURN (CRT)
208a
204
206
245
GAME TYPE PAY LINE
GAME TYPE
PAY LINE
PRIZE ID
COIN REQUIRED (CR)
WIN CYCLE (WC)
244
246
208b
248
252

FIG. 2-B
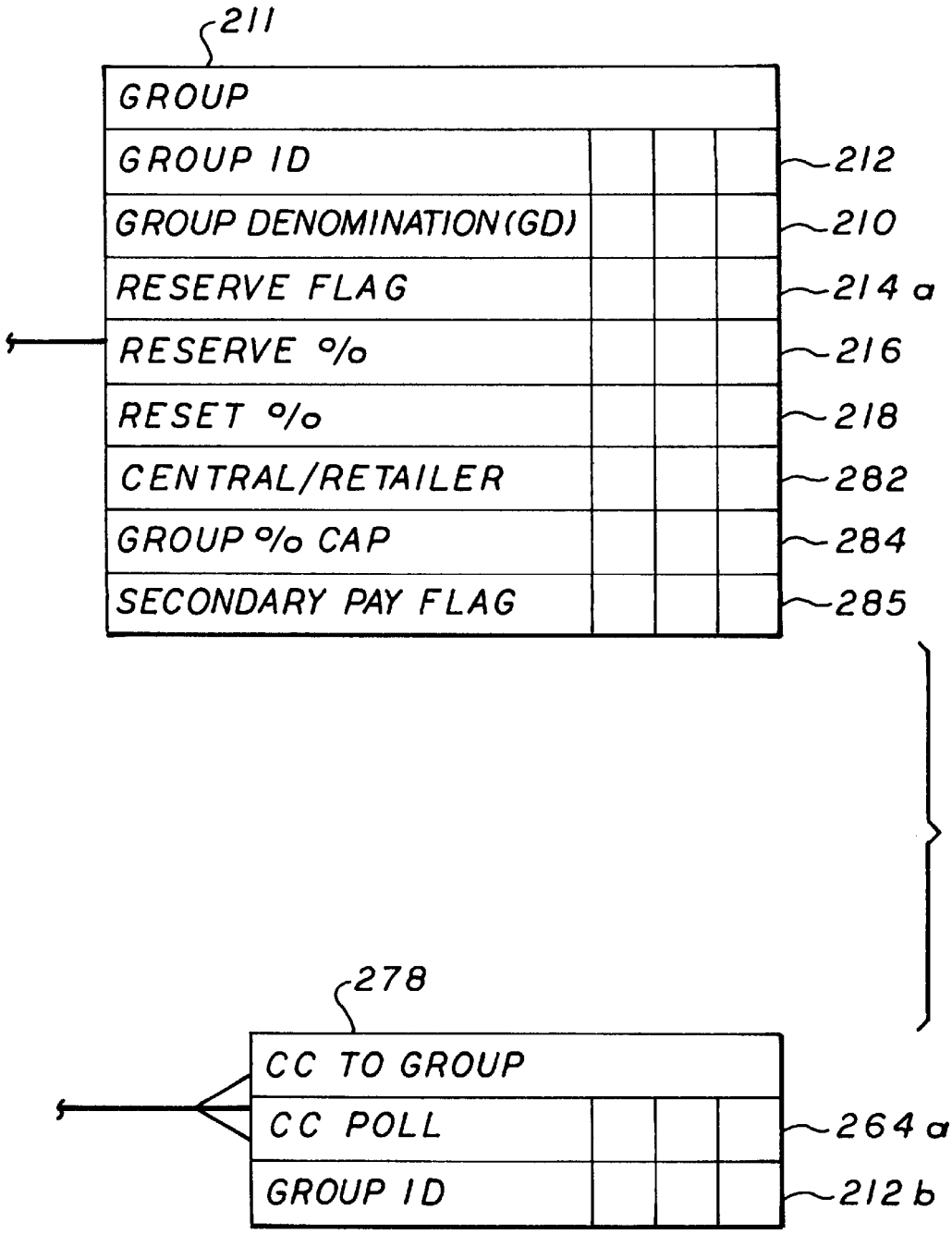

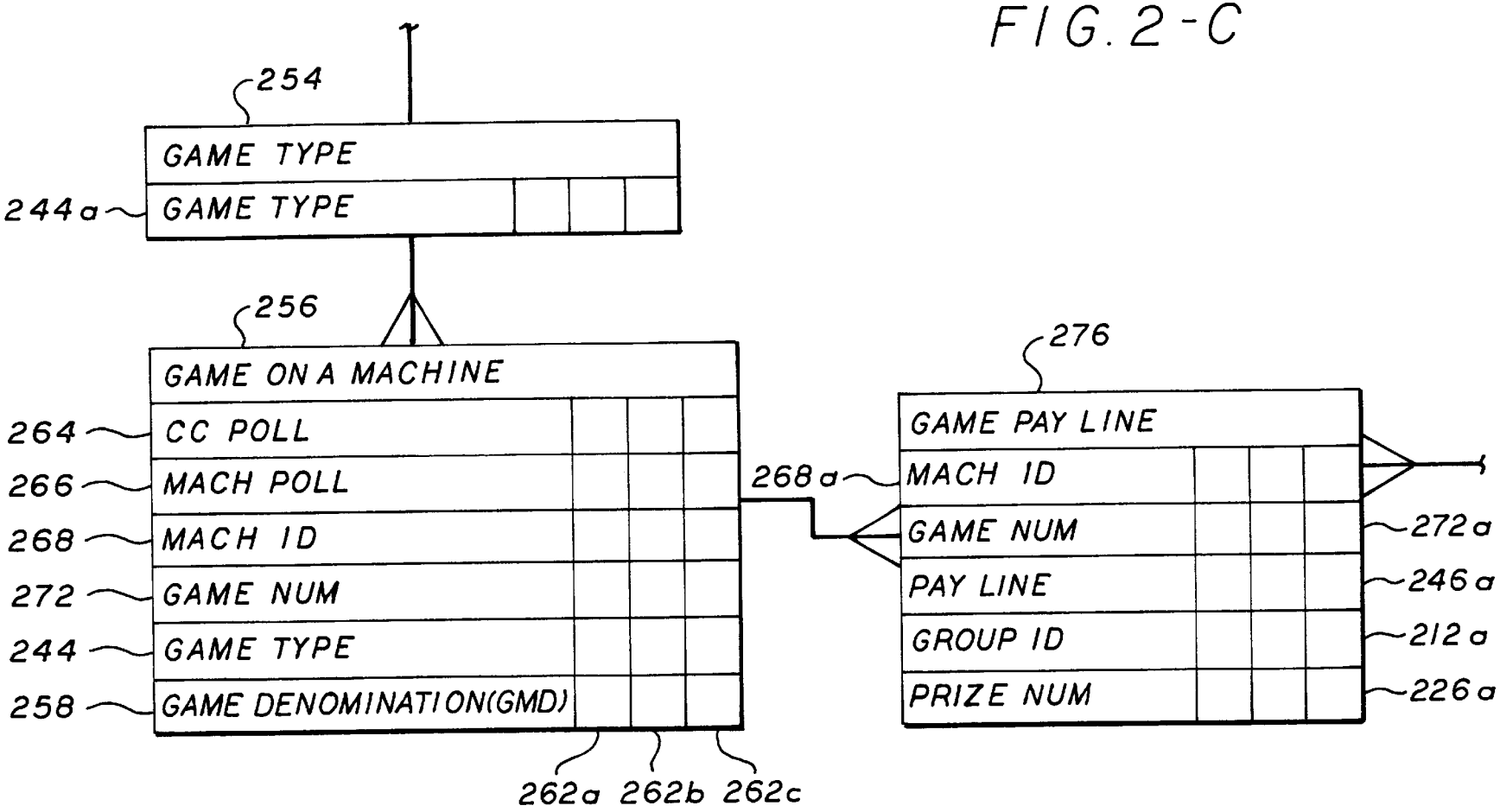
FIG. 2-C

FIG. 6-A
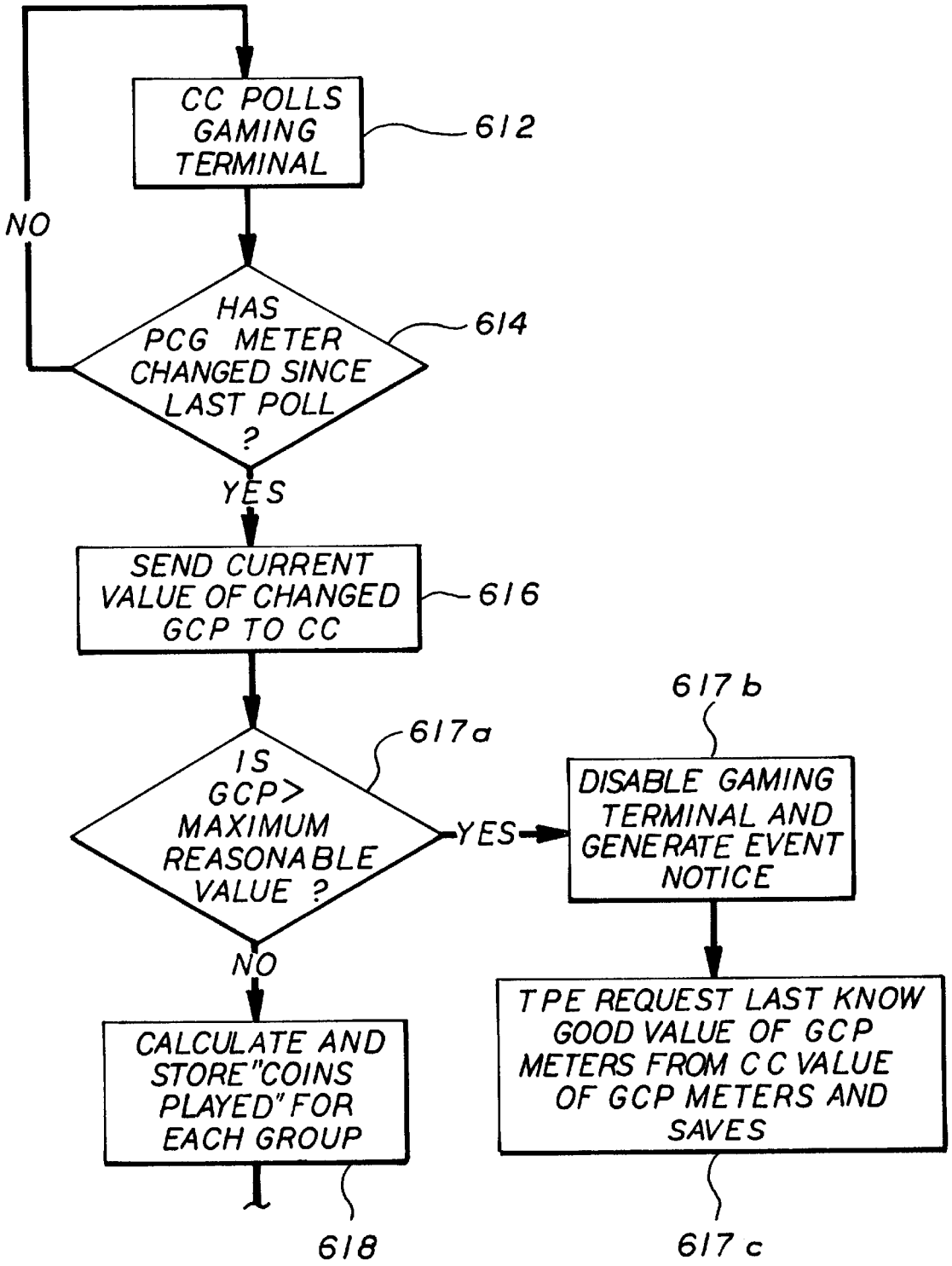

FIG. 6-B
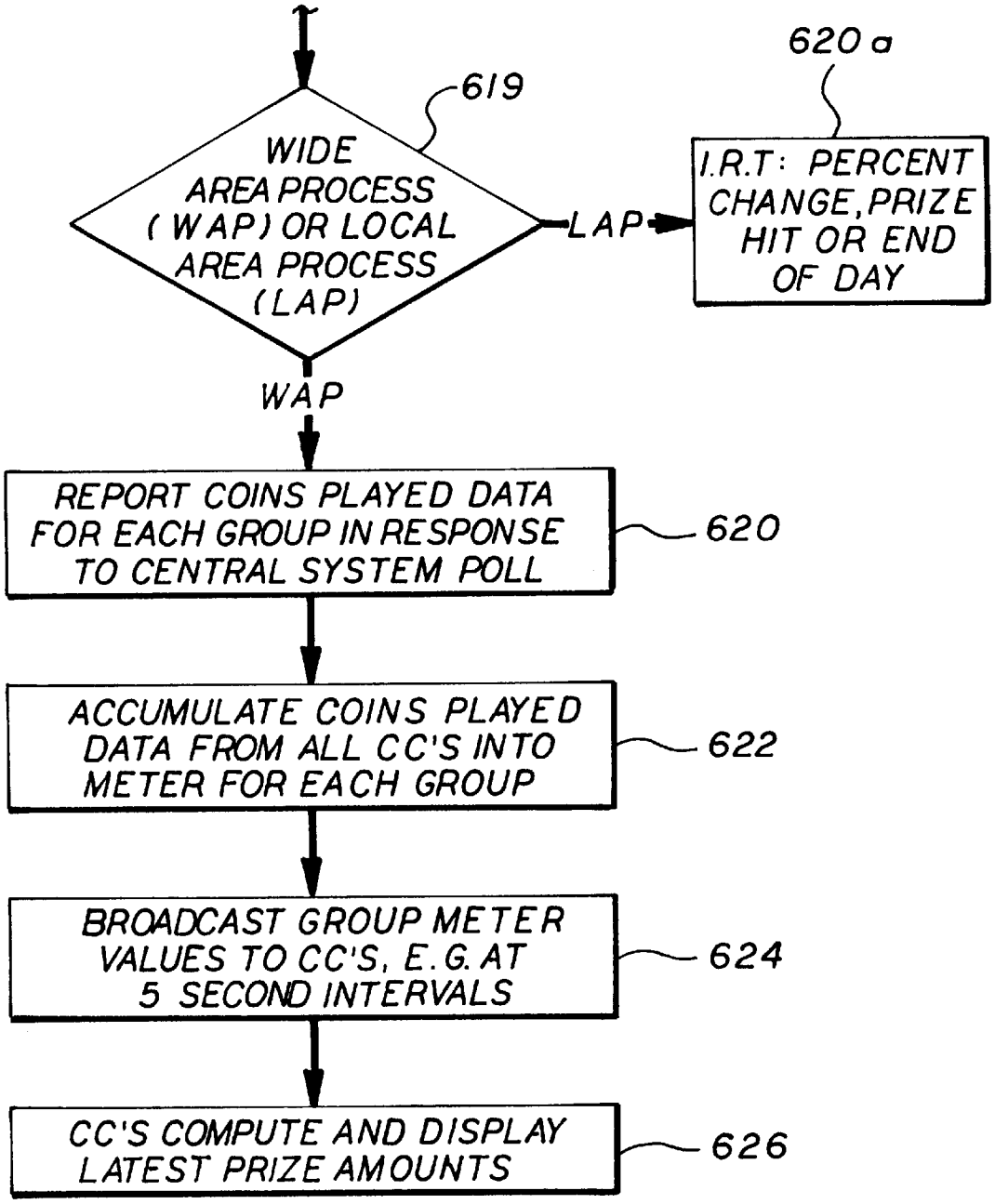

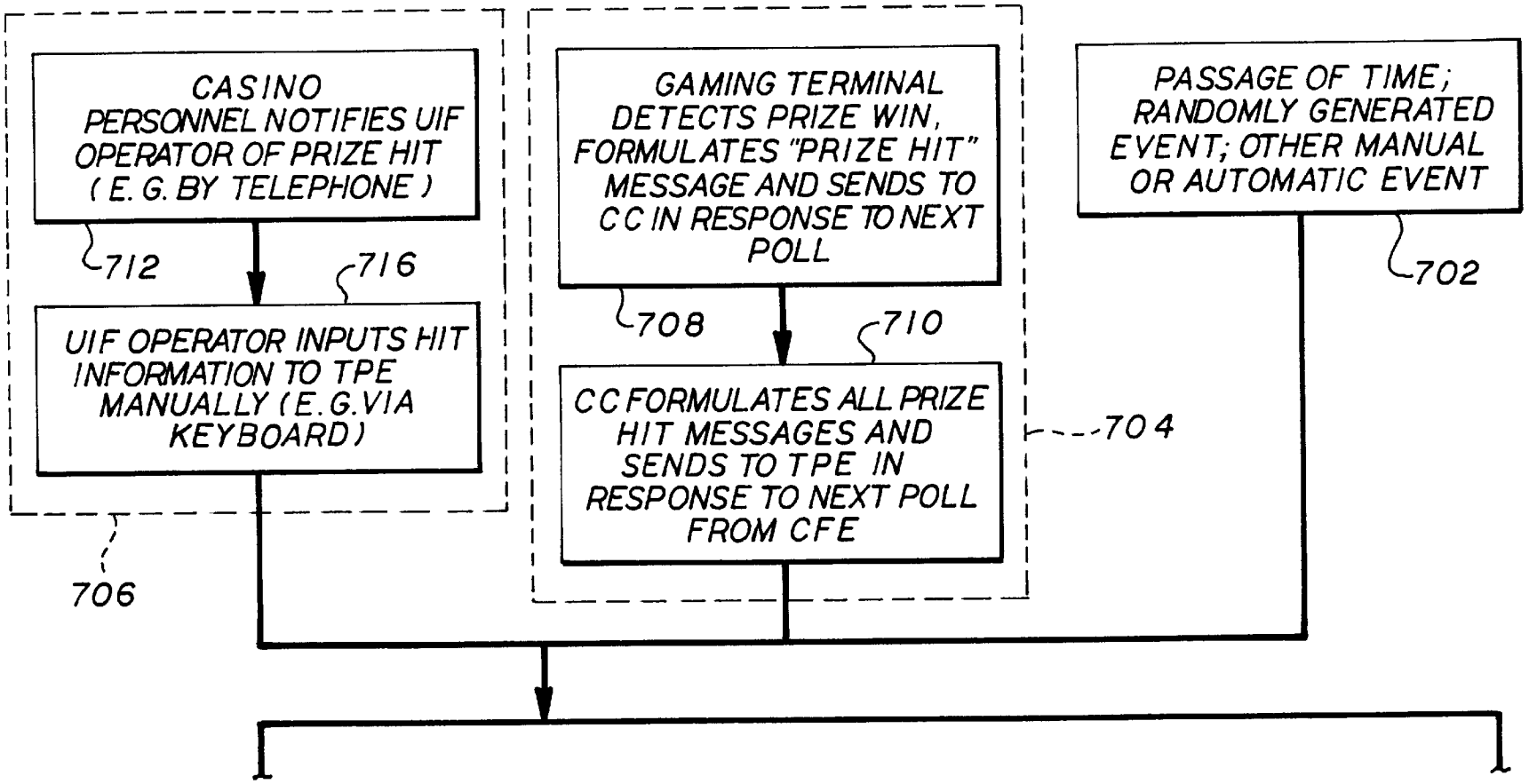
FIG. 7-A

FIG.7-B
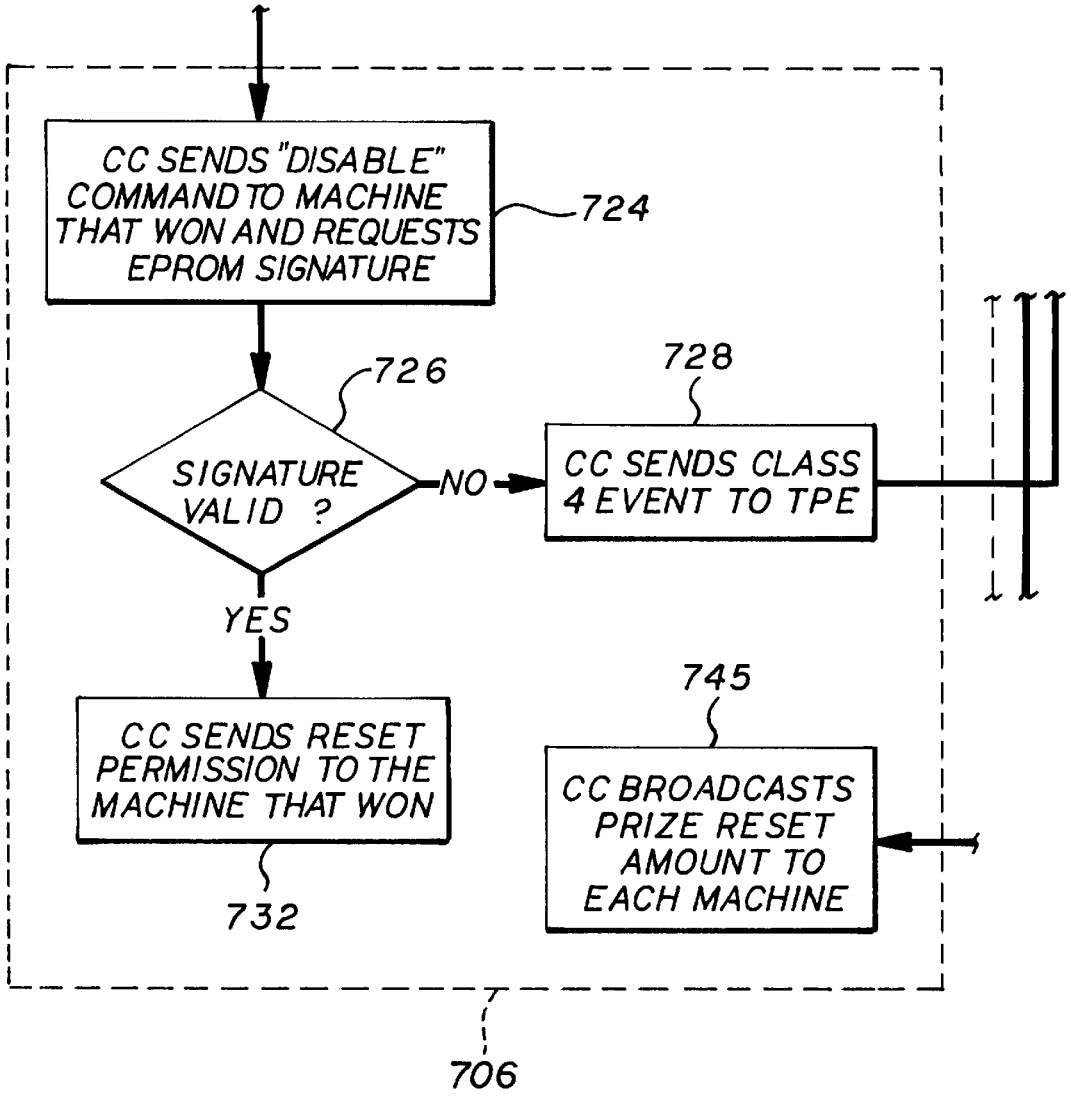

FIG. 7-C
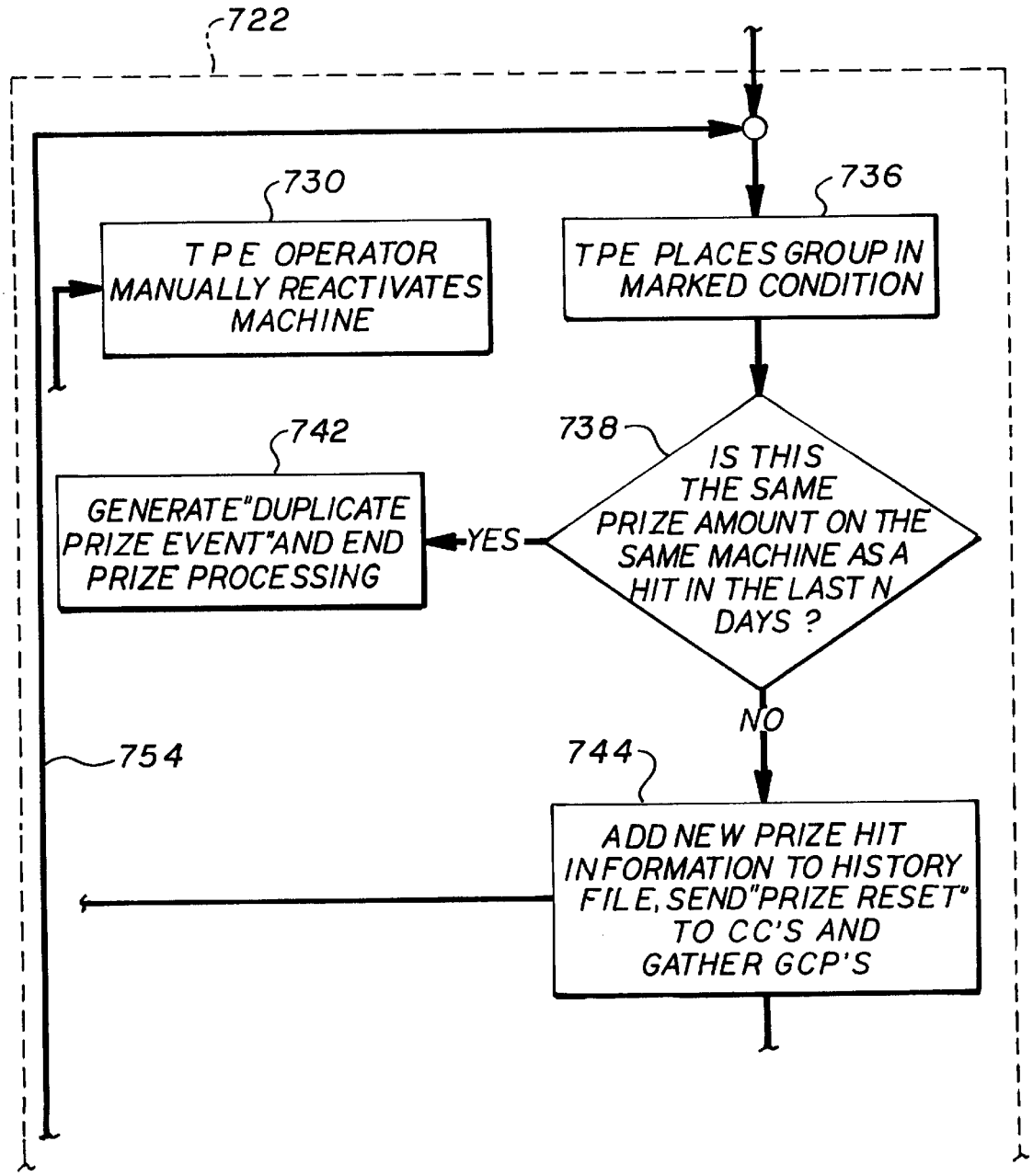

FIG.7-D
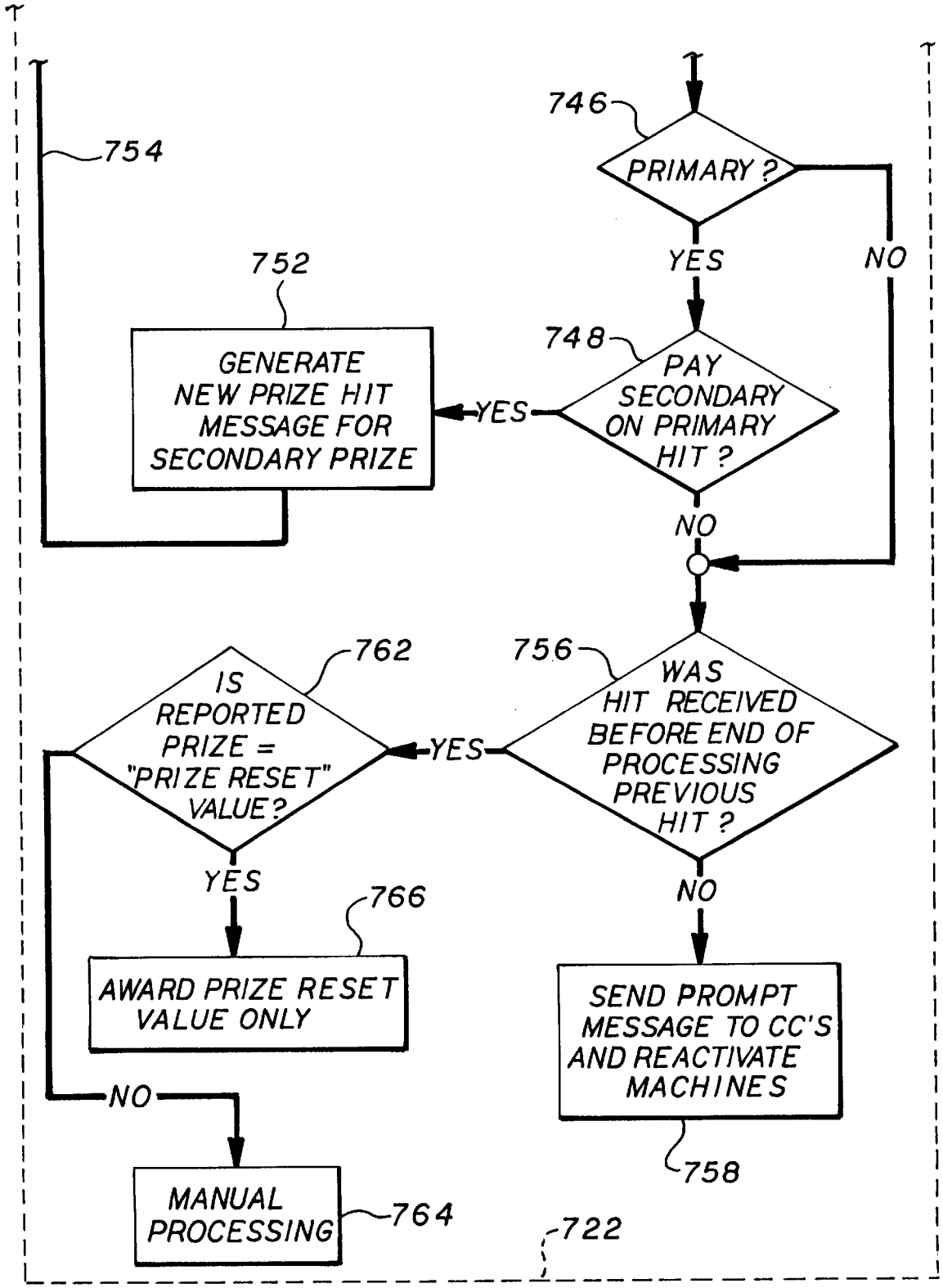

FIG.8-A
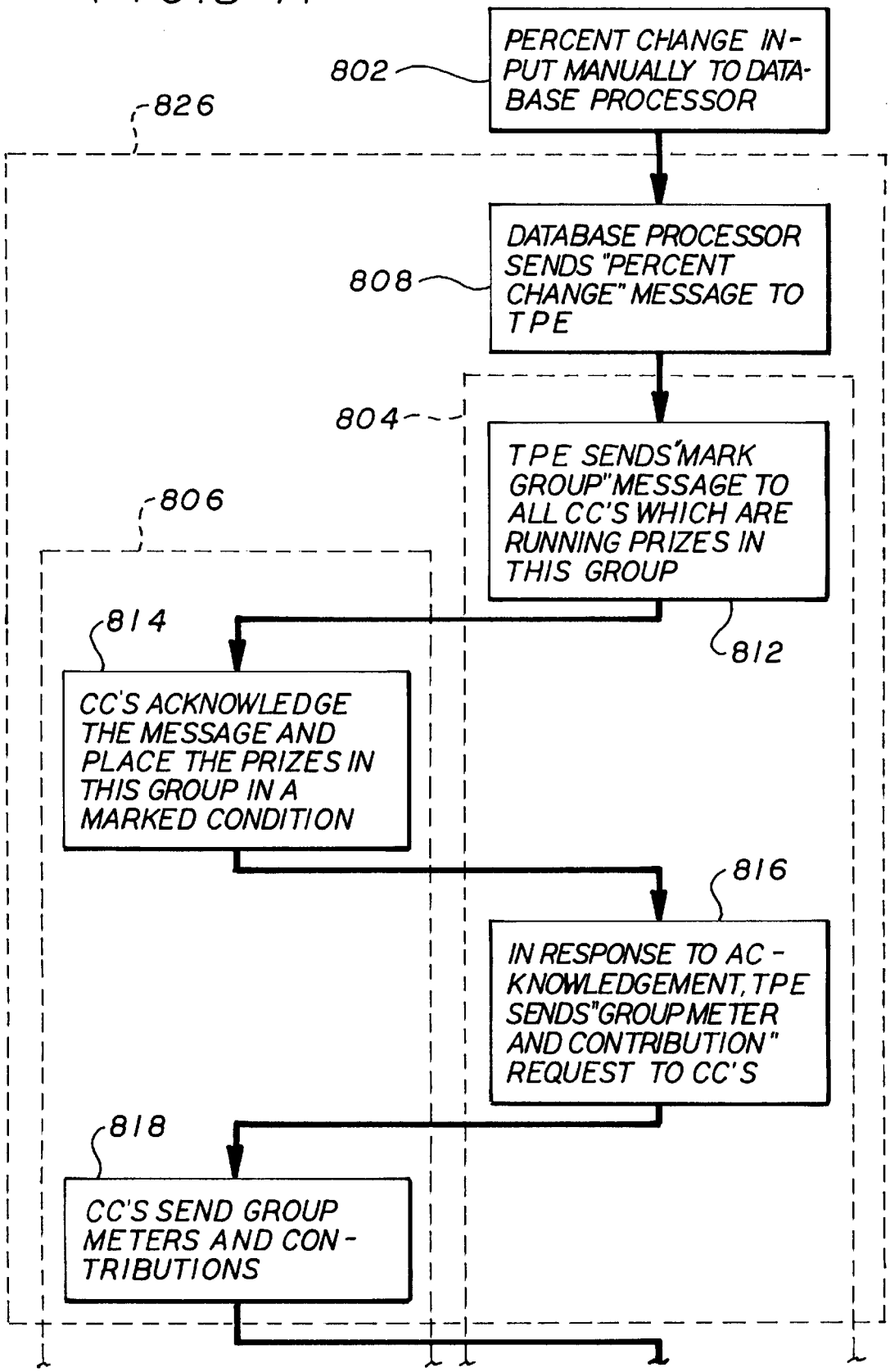

FIG. 8-B
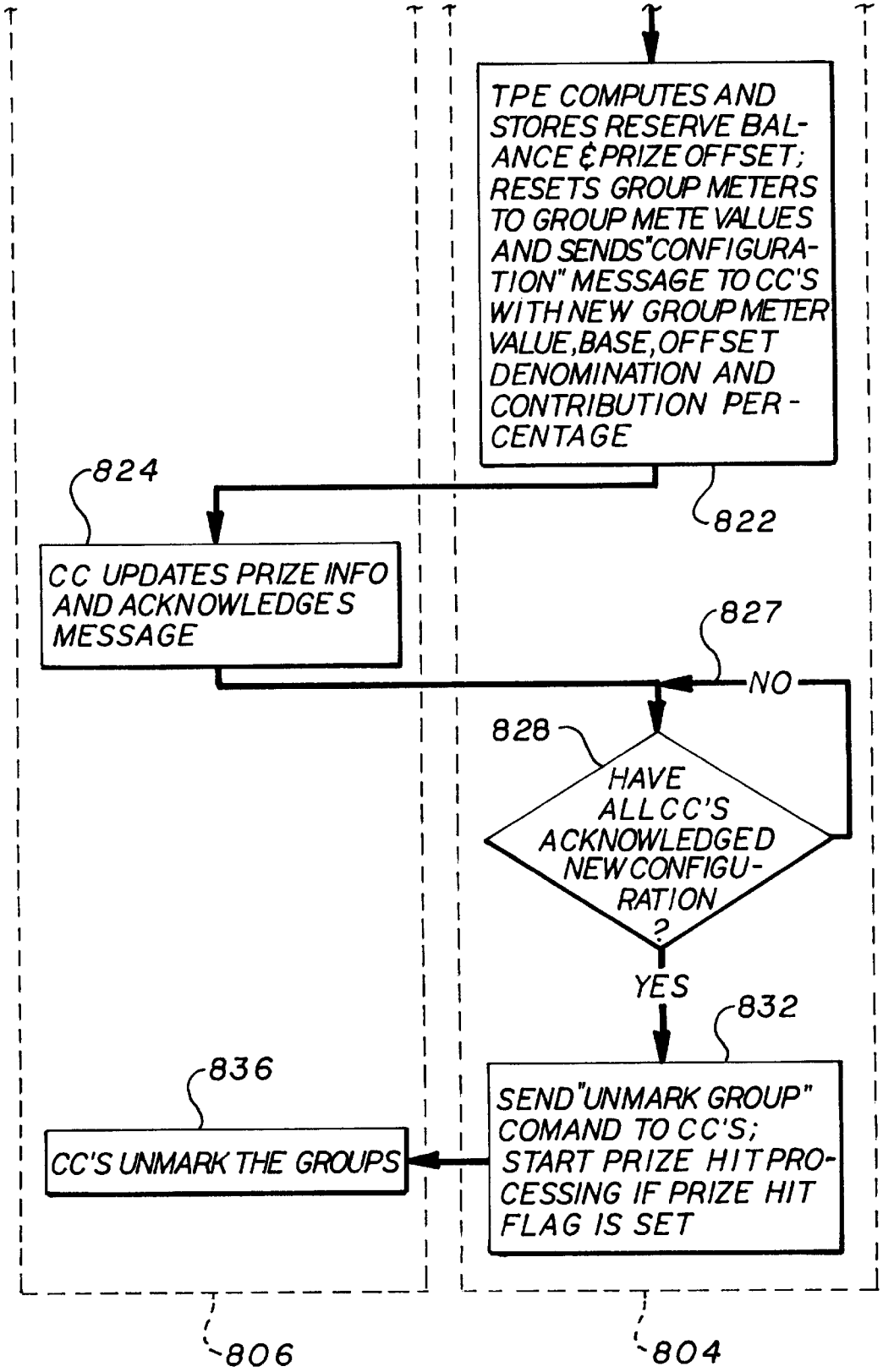

FIG. 10-A
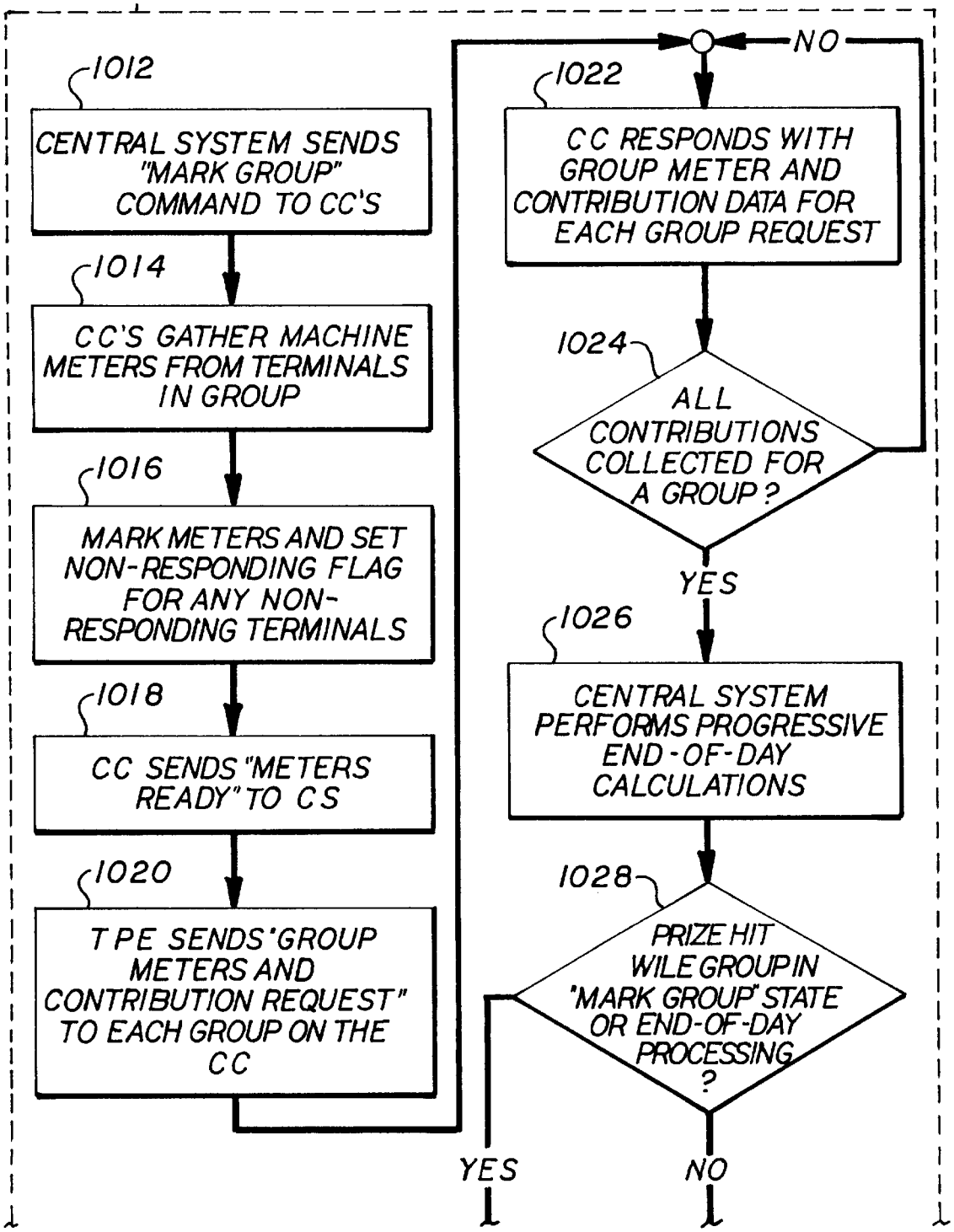

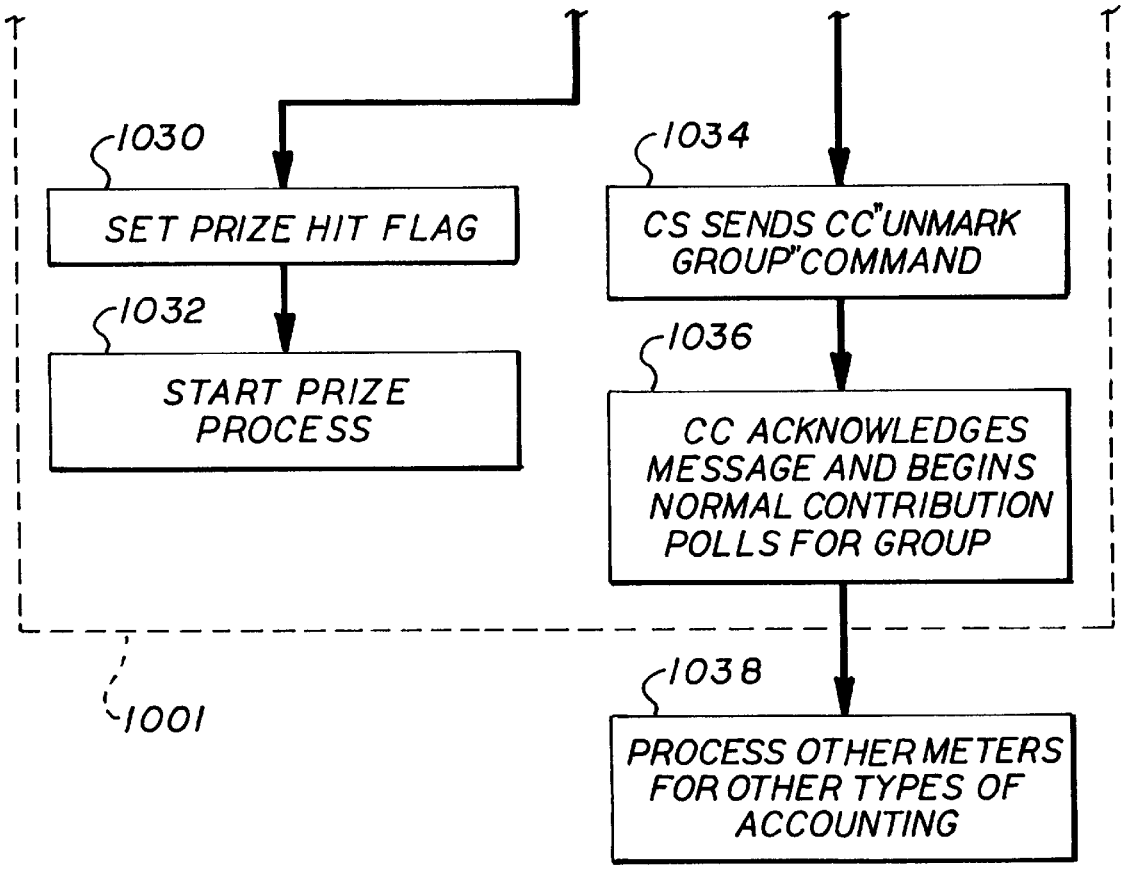
FIG. 10-B

GAMING SYSTEM FOR MULTIPLE PROGRESSIVE GAMES

Cross reference is made to U.S. patent application Ser. No. 08/600,6707 (Attorney File No. 27224/90400) for Progressive Gaming System filed Feb. 13, 1996, and incorporated herein by reference.

The present invention relates to a system for progressive gaming, in particular to a system which can accommodate multiple progressive games and/or prizes using a single central system for processing prize amount determinations for all games.

BACKGROUND INFORMATION

Gaming systems have included progressive systems in which machines are linked together so that, in addition to the normal games played on the gaming machines, players can compete for an additional prize. In a progressive game, each coin played on a progressive game terminal contributes a percentage of its denominational value to the prize amount, and in this way the prize amount may increase at a rate related to the percentage factor and player participation. One type of progressive gaming system is described, for example, in U.S. Pat. No. 4,837,728 issued Jun. 6, 1989 and assigned to International Game Technology. Although progressive gaming systems have proved to be successful, it is believed there is a potential to provide progressive gaming systems which could make the systems available to a larger number of players, provide for economies of scale, and provide for greater flexibility in establishing and maintaining progressive gaming systems.

In the past, progressive gaming systems have typically been organized such that any gaming terminal which provides a chance at a progressive prize is coupled, at least indirectly, to a central computer which, for example, calculates the total amount of the progressive prize. In typical previous systems, all gaming terminals which provided a chance at a given progressive prize were coupled to the same central computer and were eligible for only a single progressive prize. In previous devices, a given central computer which was used in calculating the amount of a progressive prize was typically used for only a single progressive game and a single progressive prize. In typical previous systems, if there were two progressive games, each progressive game would be associated with a different central computer and no single gaming terminal was eligible for participation in the two different progressive games. In typical previous systems, numerous central computer systems were required if several progressive games were desired, each typically requiring its own communications system. The cost of providing such multiple computer and communications systems is believed to have limited the availability of progressive gaming systems.

Furthermore, in the past, progressive systems, as implemented, have typically provided that each gaming terminal providing eligibility for a given progressive prize was configured to have the same odds of winning the progressive prize and to require the same amount of bet or wager for a given chance at the progressive prize. In U.S. Pat. No. 5,116,055, a system was proposed in which different denominations and hit frequencies would be provided for gaming machines in a progressive gaming system. In this system, several parameters of the system, including the percent-to-jackpot ratio of the various gaming machines, could be provided with non-integral values. It is believed that certain non-integral parameters may be disfavored in a number of gaming regulatory jurisdictions and that previous devices providing such parameters as integral values have done so by requiring all gaming devices to have the same odds and amount of bet for a chance at a progressive prize.

In the past, progressive systems have typically been configured so that the event which triggers a win of a progressive prize is a win on one of the gaming terminals or some other event related to a particular game logic.

Accordingly, it would be advantageous to provide a progressive gaming system which has the ability to run many progressive prizes on one central system, which is not restricted to providing for the same odds and amount of bet for a chance at a progressive prize and/or which can provide an event trigger allowing the win of a progressive prize to be created by an event unrelated to any particular game logic. In this way, it is believed possible to provide for a progressive gaming system which is more flexible, economic and more widely available than previous progressive systems.

SUMMARY OF THE INVENTION

The present invention provides for a single central system which is coupled to multiple gaming machines in which two or more subsets of the gaming machines are eligible for two or more progressive games, preferably each game having two or more prizes. Preferably, overlap among the subsets of gaming terminals is permitted so that a given gaming terminal may be eligible for two or more different progressive games. Unlike previous systems which typically require that all participating gaming terminals have a specific value of odds, denomination and amount of bet or which provided for non-integral values of certain parameters, the present invention includes the provision of certain common criteria which must be met in order for a given gaming terminal to be eligible to play for a given progressive prize with the common criteria being configured such that different gaming terminals eligible for the same progressive prize may have different odds, denominations and/or bet amounts. In one embodiment, each particular progressive game, regardless of the odds or bet amount, fulfills a requirement that a total buy-in amount be exactly equal to the particular progressive prize's criterion specifying the total buy-in amount required to win the progressive prize. In one embodiment, games with different denominations are allowed to play for a common progressive prize. In one embodiment, the prize is defined in terms of the number of coins expected to be played between consecutive progressive prize wins (on average) and the minimum of coins returned to a player that won the prize. This is independent of the denomination or value of the coin and thus this data is not related to odds or denominations.

Preferably, for any given progressive prize, constraints are imposed on the expected number of coins to be played before a prize is awarded, such that this expected number, divided by the product of the number of coins required for a chance at the prize on a given machine times the number of handle pulls expected before a progressive prize win occurs is an integer value.

In one embodiment, the event that triggers a win of a progressive prize can be unrelated to the events on any particular gaming terminal such as being based on a random time, a button push, a wheel spin, and the like. Unlike previous devices which typically triggered a progressive prize win or hit based on events that occur on a gaming terminal, in one embodiment of the present invention, the event which triggers a prize hit is determined by the central system, rather than by gaming terminal. In one embodiment, once the central system enters into a prize award state, the award of the prize becomes a random event, e.g., associated with the first handle pull detected by the system.

BRIEF DESCRIPTION OF THE DRAWINGS

FIG. 1 is a block diagram of a progressive gaming system according to one embodiment of the present invention;

FIG. 2 depicts the data structure for a database which can be used in one embodiment of the present invention;

FIG. 6 is a flow chart of a process for accumulating contributions according to an embodiment of the present invention;

FIG. 7 is a flow chart of a process for handling prize hits according to an embodiment of the present invention;

FIG. 8 is a flow chart of a process for making a percent change according to an embodiment of the present invention;

FIG. 10 is a flow diagram showing end of day processing according to an embodiment of the present invention.

DETAILED DESCRIPTION OF THE PREFERRED EMBODIMENTS

Figure 3:
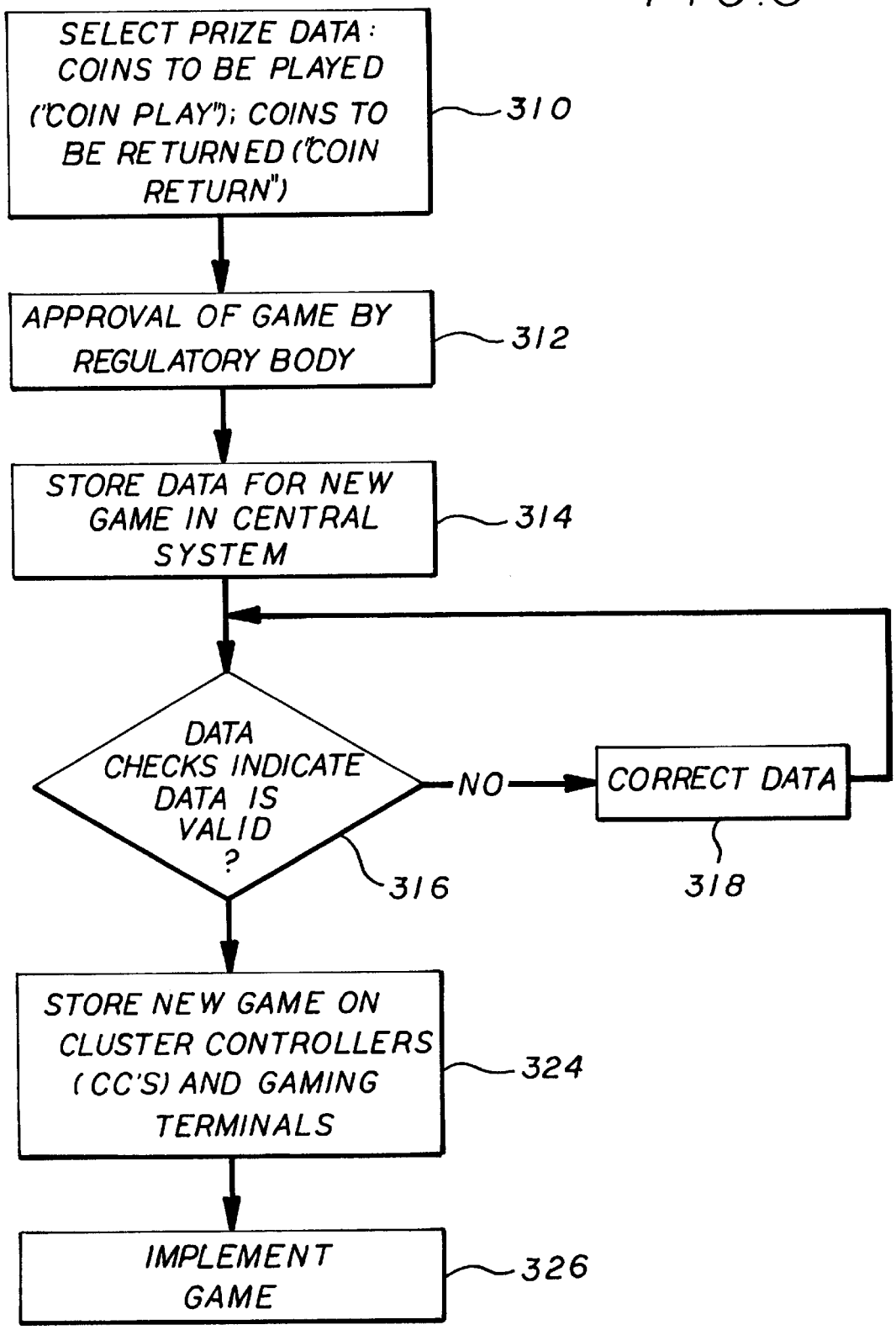
FIG. 3 is a flow chart of a process for implementing a new game according to an embodiment of the present invention.

Before describing features of the present invention, it is believed useful to describe features found in certain progressive gaming systems. Typically, a group of electronic gaming terminals is identified that will participate in a progressive game and these are coupled to a central computer, often via intermediate computers or other communication and/or control devices. A central computer stores information relating to, e.g., a prize base amount, percent of contribution from each coin used to increment the prize amount, the percent used to increment a reserve amount (for funding future prizes) and the like. The central system polls a cluster controller or other intermediate controller which responds with information about the number of coins played and/or the amount of contribution towards the progressive prize for all progressive-eligible gaming terminals coupled to that cluster controller. The central system computes the new prize and reserve amounts and broadcasts information to the cluster controllers for, e.g., displaying the prize amount to players. The cluster controllers also provide information to the central system when a particular gaming terminal has experienced a progressive prize hit or win. In the event of a progressive prize win, the central system contacts each cluster controller, gathering the last of the play to be included in the prize hit and coordinates the prize reset to begin another progressive game.

FIG. 1 depicts a progressive gaming for use in connection with an embodiment of the present invention. In the embodiment of FIG. 1, a plurality of gaming terminals 106*a*–106*l* are provided. Each gaming terminal provides a device for receiving money, credits, coins, etc. from a player and a player input device permitting the player to make play decisions, initiate play, place wagers, etc. A number of input devices can be used and a given terminal may have two or more input devices. Input devices may include, for example, a keypad, an arm or lever (such as a slot machine arm), a touch screen, joystick, or the like. Each gaming terminal also includes output devices which can be used to inform the player of the results of the game, amount of wager, occurrence of a win, etc. Output devices may include a video display screen, slot machine reels, a speaker or other audio output, activatable lights and the like.

Preferably, each gaming terminal contains a controller such as a microprocessor, for controlling play on the terminal. The microprocessor may, for example, coordinate operation of the various components or peripherals such as a coin acceptor, a currency validator, input devices, output devices and the like, so as to allow the user to play the game, receive the appropriate wagers and dispense or credit the appropriate winnings. Preferably, each controller is also coupled to a memory for storing data and program instruction for controlling the play as well as storing and/or communicating information for accounting purposes and for progressive games as described more thoroughly below. One or more of the gaming devices may be coupled to a notification device 107*a* for providing notification that a progressive prize has been won. Alternatively, or in addition, a notification device 107*b* may be coupled to one or more cluster controllers 105*b*, as described below. A notification device 107 may take a number of forms including a video, LCD or LED display, a controllable speaker, bell, alarm, etc., a printer and the like. Although only two notification devices are depicted in FIG. 1, notification devices may be provided in a number of locations, such as coupled to all gaming terminals.

The gaming terminals 106 may be physically located in a number of fashions. In the depicted embodiment, gaming terminals 106*a*–106*h* are located in a first retail location 110*a*, such as a first casino or first region or portion of a casino, and gaming terminals 106*i*–106*l* are provided in a second physical location such as a second casino. A group such as the third group 134*c* which is associated with a single cluster controller 105*b* is typically termed a local area progressive group (LAP) while a group such as groups 134*a* or 134*b* associated with two or more cluster controllers 105 is termed a wide area progressive (WAP) group. A given group may be designated as a either a system group or a retailer group as desired, regardless of the number of cluster controllers, machines or games attached to or associated with the group.

Although FIG. 1 depicts only twelve gaming terminals, the present invention is configured to allow the central computing system 112 to control a large number of gaming terminals, typically limited by the memory, communication facility or other hardware components which are installed. In one embodiment, a central system 112 is provided with the ability to control at least about 35,000 or more gaming terminals.

Although it is possible to provide for direct communication between central system 112 and gaming terminals 106, in the depicted embodiment, groups of gaming terminals are coupled to intermediate communication/control devices termed cluster controllers (CC) 105–105*c*. In general, the cluster controllers are used for maintaining constant contact with each gaming machine and for summarizing and encapsulating the machine data, processing events and sending data to the central system 112. Preferably, the cluster controllers 105 include microprocessors coupled to modems or other communication devices for communication with the central system 112 and contain local area network hardware and software or other communication systems for communicating with the gaming terminals 106. The gaming terminals 106 may be coupled to the cluster controllers 105 in a number of different fashions. In the embodiment depicted in FIG. 1, gaming terminals 105*a*–105*d* are coupled to cluster controller 105*a* in a daisy chain topology, gaming terminals 106*e*–106*h* are coupled to cluster controller 105*b* in a daisy chain topology and gaming terminals 106*i*–106*l* are coupled to cluster controller 105*c* in a star topology. Preferably the cluster controllers provide input and output devices such as keyboard, printer, screen, etc. The gaming terminals 106 may be coupled, either directly or by a cluster controller 105 to a local (e.g., casino) network such as a token ring network, e.g., for providing information to a plurality of computers for various purposes such as security, jackpot/fill booth operation, scale interface, camera interface, club booth, management and transaction processing.

Each gaming terminal 106 stores information which can be used to determine the number of coins played at least in those wagers which permit a chance at a progressive prize. In one embodiment, a meter (which may be memory locations coupled to a gaming terminal microprocessor) stores the total number of the lowest legal coin (in the United States, the number of cents) played in wagers which qualify for a chance at a progressive prize since the last "reset" of such meter. If a gaming terminal can participate in more than one progressive game (e.g., terminals 106*c*–106*e* or 106*g* and 106*h* in the embodiment of FIG. 1), a "gross cents played meter" (GCP) is provided for each game.

In general, the central system 112 can be viewed as organized in three tiers, a processing tier 113*a*, a communication tier 113*b* and a database tier 113*c*. The central computer system 112 provides a real time processing system (RTS) 114 for receiving progressive gaming information, declaring a win event, and the like as described more fully below. In one embodiment, the real time system includes a transaction processing engine (TPE) 116 for, among other functions, communicating with the various cluster controllers, as described below and a progressive processing engine (PRG) 118 for, among other functions, processing the accumulation of contributions, prize hits and percent changes. The TPE 116 and PRG 118, in one embodiment, are implemented by software controlling a real time system computer 114. A number of computers can be used for the real time system including those sold under the trade names DEC VAX or DEC ALPHA. In the embodiment of FIG. 1, the real time system 114 is coupled to a database processor 120 for storing and accessing data used in the progressive system as described more thoroughly below. Data based on that sent from the cluster controllers, data describing characteristics or features of various gaming terminals and of the progressive games being run by the central system 112 and data for auditing, billing and reporting may be included.

In the embodiment depicted in FIG. 1, an attached processor is coupled to the real time system to provide a user interface (UIF) 122 for operators to issue commands to the real time system 114 or to query its current status and data.

The communication tier 113*b* is responsible for providing intelligent communications between the processing tier 113*a* and the cluster controllers 105. The procedures at this level use some of the processing tier data to control polling and message routing to and from the cluster controllers. FIG. 1 depicts two types of communication computers. A dial up front end controller (CFE) 126*a* provides for communication to cluster controller 105*a* over a dial up telephone line 132*a* on a scheduled basis. Dedicated front-end controllers (CFE) 126*b*, 126*c* maintain communications between the real time system 114 and on-line cluster controllers 105*b*, 105*c* over dedicated telephone lines 132*b*, 132*c* via port switches 128*a* and 128*b*.

In the present invention, the central system 112 can be used to control two or more different progressive games. Preferably there is a degree of flexibility in the correspondence between a given progressive game and those gaming terminals which are eligible for a given progressive game. FIG. 1 illustrates an example in which three different progressive games are controlled by the central system 112. In the example depicted in FIG. 1, a first group of gaming terminals 134*a* consisting of terminals 106*a*–106*e* participate in a first progressive game, a second group of gaming terminals 134*b* participate in a second progressive game and the third group of gaming terminals 134*c* participates in a third progressive game, each progressive game having its own prizes. As can be seen from the example of FIG. 1, the system provides sufficient flexibility that games at two different physical locations can participate in the same progressive game (such as terminal 106*h* at location 110*a* and terminal 106*i* at location 110*b*). It is possible for a given terminal to participate in two different progressive games at the same time, such as terminal 106*d* which is in the first group 134*a* and the second group 134*b*. It is possible for two terminals which are coupled to the same cluster controller to participate in two different games such as terminal 106*e* participating in group 134*a* and terminal 106*g* participating in a third group game 134*c*, both of which are coupled to cluster controller 105*b*. It is also possible for there to be two gaming terminals coupled to the same cluster controller in which one participates in a progressive game while the other does not participate in any progressive game such illustrated in FIG. 1 for terminals 106*i* and 106*j*.

The central system 112 is configured to accommodate the desired flexibility in correspondence between gaming terminals 106 and progressive game groups 134, as well as to provide checks to assure that progressive games and progressive game groups are appropriately selected and set up, checks to reduce the occurrence of cheating and systems for providing accounting and management information.

FIG. 2 depicts the organization of data in various tables of a database according to one embodiment of invention. In the depiction of FIG. 2, the lines connecting the various tables indicate the relationship between the tables. A connecting line with branching lines at one end indicates a one-to-many relationship with the branched end indicating the "many" end of the relationship. A line with branches at both ends indicates a many-to-many relationship. In the depiction of FIG. 2, data for two different progressive games would be stored in different columns of the respective prize tables. Although only three columns are depicted in FIG. 2, many columns can be provided. FIG. 2 shows a particular manner of storing pertinent data in a number of tables of a database. As will be clear to those of skill in the art, this data (or similar data) can be stored in other fashions as well. Those of skill in the art will understand how to provide appropriate computer data storage and access to reflect the structure and relationships illustrated graphically in FIG. 2. As noted, there may be many progressive contests implemented on single central system 112 and data used for characterizing and controlling all of these progressive games may be stored in a database such as that depicted in FIG. 2.

In one embodiment, these systems are configured to store appropriate data, e.g., using database processor 120 organized in two main categories: prize data and group data. In general terms, the prize data relates to the frequency and size of a given progressive prize, while the group data relates to the identity and characteristics of the various gaming terminals, and certain other features of the progressive games and prizes important to functionality and integrity of the system, as described more thoroughly below. In general, providing a new progressive game begins by first establishing the prize data (FIG. 3). The frequency and size of the progressive prizes are selected primarily for marketing considerations, within the constraints imposed by particular regulatory jurisdictions.

After the prize data for a proposed new game has been selected 310 and approved by the regulatory body 312, the data characterizing the new game (described more fully below) is stored on the central system 112. The central system 112 is configured to perform various checks (e.g., as described below) on the new game 316 to assure that the new game has been properly configured, i.e., that it will not result in unacceptable losses (e.g., resulting from an error in data input) and that the desired accounting and reporting will be performed as described below. If these checks fail, a report is printed indicating the reason for the failure so that the data can be revised 318 in order to resolve such failures. The procedure then loops 320 to repeat such checks until such time as the checks indicate that the game is properly configured 322. Once the data on the central system has been verified as proper and stored on the central system, appropriate data relating to the new game can be stored 324 in the cluster controllers 105 and/or gaming terminals 106. For example, the data may be used by the cluster controllers 105 or gaming terminals 106 to control a display device which displays information about the prize of the new game or games. Preferably, a progressive game according to the present invention can be implemented without changing already-existing progressive logic or the states that the logic exists within. The system is now configured to implement the new progressive game 326. The game is implemented 326 when the game's progressive pay lines 246*a* are attached to the group's prizes 212*a*, 226*a*. Use of the system in play of progressive games will be described more thoroughly below.

In order to understand the use of the data which describes the progressive game, including various consistency and other checks, it will be useful to first describe some of the data which is stored in the central system in connection with a progressive game in the depicted embodiment. As depicted in FIG. 2, a prize type table 202 identifies the particular type of prize by the number of coins that are expected to be played (on average) before a win of the progressive prize occurs, referred to as "coin play" 204, and the minimum number of coins that must be paid to a prize winner referred to as "coin return" 206. In the embodiment depicted, the coin play 204 and coin return 206 are defined in terms of numbers of coins, regardless of what may be the denomination of those coins. A given central system may store data for a large number of different prize types and preferably each prize type is identified by a prize ID number 208. A given prize type may be re-used for many different progressive games. On a larger system there may be hundreds of different game types representing various progressive game logic used to play for progressive prizes. Typically, the decision regarding the particular mix of game types that will be played on the various machines coupled to the central system 112 and the participating progressive prizes is a marketing decision, within the constraints of the particular regulatory jurisdiction.

The coin information stored relative to a prize type 202 is related to a specific dollar amount by a group denomination 210 which, in the depicted embodiment, is stored in a group table 211. A group is a set or collection of gaming terminals which are eligible for a given progressive prize, i.e. which can be used to place wagers or otherwise obtain a chance at a progressive prize. It is important to note that the group denomination 210, in the illustrated embodiment, establishes a denomination for the group but that this does not mean that any particular gaming terminal in that group is restricted to being a gaming terminal that accepts only that denomination of coin. The group denomination 210 is used to compute various values as described below but is not a constraint on the denomination or other characteristics of a particular gaming terminal in the group. As noted above, according to the present invention a gaming group may contain gaming terminals which have many different gaming terminal denominations, such that a group may contain, e.g. both dollar slot machines and quarter slot machines. In FIG. 1 three groups are defined: 134*a*, 134*b*, 134*c*. Each group is identified by a group identification number 212. If desired, a reserve fund may be established for each group which can be used, e.g., to fund the base amount of the next prize after a given progressive prize has been won. In the depicted embodiment, some items may be stored in more than one table, such as the reserve flag 214, 214*a*. In the embodiment of FIG. 2, a reserve flag 214 indicates whether or not a reserve fund is used for this group prize. The reserve percentage 216 contains the percentage factor used to compute the contributions to the reserve fund. In one embodiment, if it is desired to establish a reserve percentage which is initially relatively low, following a progressive prize win, (primarily for marketing reasons) a reset percentage 218 can be used to store a value that replaces the reserve percentage 216 whenever a prize hit event forces initialization of the group and prize data, as described below.

If desired, other information pertinent to a progressive game can be stored. Examples include an identification of whether the central system or a retailer 282 is responsible for the progressive prize's accountability. The entity that is identified will typically manage the funds generated by contributions and pay the prize amounts when a prize hit occurs. If desired, a group percentage can be stored as a cap 284 on the total contributions to the reserve fund and prizes. This percentage provides some protection against error or cheating that may result in setting a contribution percent factor 222 to an unreasonably high level.

As noted above, a given progressive game may have two or more prizes, if desired. In one embodiment, it may be desired to pay out a secondary prize whenever a primary prize has been won and a logical flag 285 may be stored to indicate whether this option is desired.

In the embodiment of FIG. 2, a group prize table 224, associates a given group 212 with a particular prize type 202. Thus, a particular entry in a group prize table 224 may include an identification of one of the groups 212 and an identification of a prize type identifier 208 which is a prize for that group. As noted, a given group may have two or more prizes. In the depicted embodiment there are a maximum of two prizes for each progressive group and the group prize table 224 includes a prize number 226 which indicates whether that particular prize type 208 is a primary prize or a secondary prize. Thus, another consistency check which can be performed is to verify that for each given group, there is at least one but no more than two prize types defined for that group 414. The percent of contribution 222 indicates what percent of the "cents in" revenues received by a gaming terminal on those bets which are eligible for a progressive prize, are to be contributed toward the prize fund. The base amount 232 is computed as the product of the coin return 206 and the group denomination 210.

After a particular progressive prize is won, preferably the progressive game commences anew and a new progressive prize is provided (which increases according to the contributions 222 made by the gaming terminals 106 toward that particular progressive prize). Preferably, after a progressive prize has been won, the prize for the next progressive game will start at some non-zero amount. This amount is stored in a group prize table 224 as the base reset 236, i.e., the amount that will replace the base amount whenever a prize hit event forces initialization of the group and group prize data. If desired, the base reset amount 236 may be set to an amount which is greater than the base amount 232, e.g. if increasing the prize amount is desired, e.g. for marketing reasons. As a guard against errors or cheating, a maximum prize amount 238 is stored. Under no conditions can a prize amount 232 exceed the maximum prize value 238 and this condition is preferably verified 514 when a new game is defined. As another check 516, if desired, a maximum daily boost value 242 may be stored. This value represents the maximum dollar amount that a prize amount can grow in one day. If desired, other information (not shown) may also be stored as part of the group prize information. For example, information may specify the class of events 286 which trigger a group prize win and/or determines how the prize event is processed (such as the administrative requirements to be followed before the machine can be enabled) such as in a "group type" variable (not shown in FIG. 2). Information can be stored 288 that defines how the payoff is handled if there is more than one winner for a prize. This information can be used, e.g., by persons handling the paperwork associated with a progressive prize.

In many gaming devices, characteristics of the game are defined by "pay lines" which define various possible results of a game and what payout (if any) is triggered by such result. For example, in previous electronic or other slot machines, there may be pay lines for various combinations of symbols depicted on the reels of the slot machine with an amount of payoff associated with each such combination of symbols. In the progressive game, pay line data is also preferably defined. A particular progressive game may be identified with a given game type code 244 and is preferably referenced to a pay line hierarchy number 246 specified on the game specification sheet which has been approved by the gaming commission or other regulatory body. For each game type 244, a particular prize ID 208 is associated. In many types of gaming terminals, a user has a choice to insert different numbers of coins to play the game. In some configurations it is desired to require a minimum number of coins for a particular wager or play to be eligible for a progressive prize. Thus, in one embodiment the pay line table 245 stores, for each game type, the number of coins required 248, i.e., the number of coins that must be bet in order to qualify to win the prize for this pay line. Preferably, this value is independent of the coin denomination.

In many types of gaming terminals, the user signifies a desire to initiate the play by some action. For example, in a traditional slot machine, the user initiates play by a pull of a handle. In the depicted embodiment, the pay line table 245 indicates, for a given game type 244, the number of handle pulls (or other game initiations) 252 that, on average, would be expected before a progressive prize win occurs. It should be understood, however, that this value relates to the number of game initiations and is not limited to games in which a slot machine handle is pulled in order to initiate the game. For example, a "handle pull" may actually involve a user pressing a button, touching a predefined area of a touch screen, inserting a certain number of coins or currency, operation of a joy stock or other controller and the like.

Preferably, certain logical relationships exist between the pay line data 245 and the prize type data 202. Preferably, for any game, the coin play value 204 divided by the product of the coins required 248 times the win cycle 252 is an integer value. Constraining this ratio to be an integer insures that the number of coins to be played on this pay line before prize win occurs (on average) is compatible with the number of coins to be played according to the prize type (i.e. will not result in net revenue loss, averaged over a long period). Preferably, this integer constraint is also applied 416 in the "games on a machine" data 256 related to the specific group prize data 224.

The central system 112 also includes certain information about each of the gaming terminals 106 which is in one of the groups eligible to participate in one of the progressive games. In the embodiment of FIG. 2, the information about a particular gaming terminal includes information about the denomination of that gaming terminal, i.e., the value of the coins played on the game 258. It should be noted that the gaming terminal denomination 258 is a different concept from, and does not need to be equal to, the group nominal denomination 210. For any particular game type 244, there may be multiple gaming terminals which play that particular progressive game type. In the configuration of FIG. 2, each gaming terminal would be represented by one of the columns 262*a*, 262*b* of the "game on a machine" table 256.

The denomination 258 of a particular gaming terminal indicates the lowest value of coin (or other monetary token) which can be accepted by the gaming terminal to initiate play. For example, a "quarter" slot machine which accepts U.S. quarters would have a denomination of $0.25, while a dollar slot machine would have a denomination 258 of $1.00. It is possible for a gaming terminal which has a given denomination to also be able to accept a larger bet. For example, a particular "quarter slot machine" may accept a bet of 2 quarters, 3 quarters, or a dollar, regardless of the fact that it still has a denomination of $0.25 (since the lowest coin that can initiate play is a quarter). Furthermore, some gaming terminals may allow a user to place a bet which is smaller than the amount of money input into the machine. For example, a quarter slot machine may have a bill acceptor which permits a user to insert a dollar bill, but to play only a quarter out of that dollar on a given play, if desired. Furthermore, electronic terminals may be configured to permit a user to place bets in the absence of using standard coins or currency, such as by placing bets using credits, tokens, electronically-readable cards and the like.

Other information relating to particular gaming terminals may be stored in the game table 256 such as a "cluster controller poll number" 264 used to establish a line of communication from the TPE 116 to the cluster controller 105, a unique "machine poll number" 266 for, e.g., a low-level data acquisition computer to establish communication with the gaming terminal, a "machine identifier number" 268, which may be used to verify that the gaming terminal pointed to by the lines of communication is the gaming terminal expected to exist at that spot on the network, and/or a "game number" 272 to identify the space on the gaming terminal electronically erasable programmable read-only memory (EEEPROM) or other memory that contains a set of game type logic (with the particular game type logic being identified by the game type 244).

For each game type pay line, i.e., for each column of table 245, a set of game pay line data 276 is established. Each game pay line (i.e., each column of table 276) is related to a game by the machine ID 268, the game number 272 and the pay line (hierarchy) number 246. Each column of the game pay line table is also associated with groups by the group ID 212 and the group prize number 226.

A further safeguard is provided by a table 278 relating various groups to the cluster controllers. This data can be used to identify, for a given progressive game, which among the potentially large number of cluster controllers, control the gaming terminals that are eligible for that particular progressive game. This provides an extra check which reduces the likelihood of an erroneous relationship being established.

An important aspect of checking for integrity in the system centers around the prize type information 202. In the manner described below, the prize type information 202 relates certain game information, particularly the coin required 248, win cycle 252 and game denomination 258 with the certain group information, particularly the base amount 232 and group denomination 210. The prize type information 202 can be used to tie the logic of the game type (i.e., the driver that determines the number of coins played between prize hits) to the group prize (i.e., the driver that determines how much is paid to the prize winner). This relationship is important in insuring that errors or cheating will not expose the system to excessive losses. As noted above, one check on the system results in calculation of an integer (which is equal to the coins to be played 204 divided by the product of the coins required 248 times the win cycle 252). An important check in one embodiment of the present invention is to ensure that the product of this integer times another product (which is the product of the coins returned 206 times the group denomination 210) is equal to the game denomination 258. Note that the product of the coins returned 206 and the group denomination 210 is preferably already calculated and stored in the group prize table 224 as the base amount 232. This relationship is summarized by equation 1, as follows:

$$\left(\frac{CP}{CR*WC}\right)*(GD*)=GMD \tag{1}$$

Where CP equals the prize types "coins to be played" 204, CR equals the game type pay lines "coins required" 248, WC equals the game type pay lines "win cycle" 252, GD equals the group "denomination" (in cents) 210, and GMD equals the game denomination 258. It is useful to establish this relationship before permitting a game to be established or modified for a number of reasons. This relationship is compatible with multiple denomination play where games that have a game denomination 258 that is a multiple of the group denomination 210 are allowed to play for the group's progressive prizes. Different group pay lines are allowed to play for different group prizes.

Figure 4:
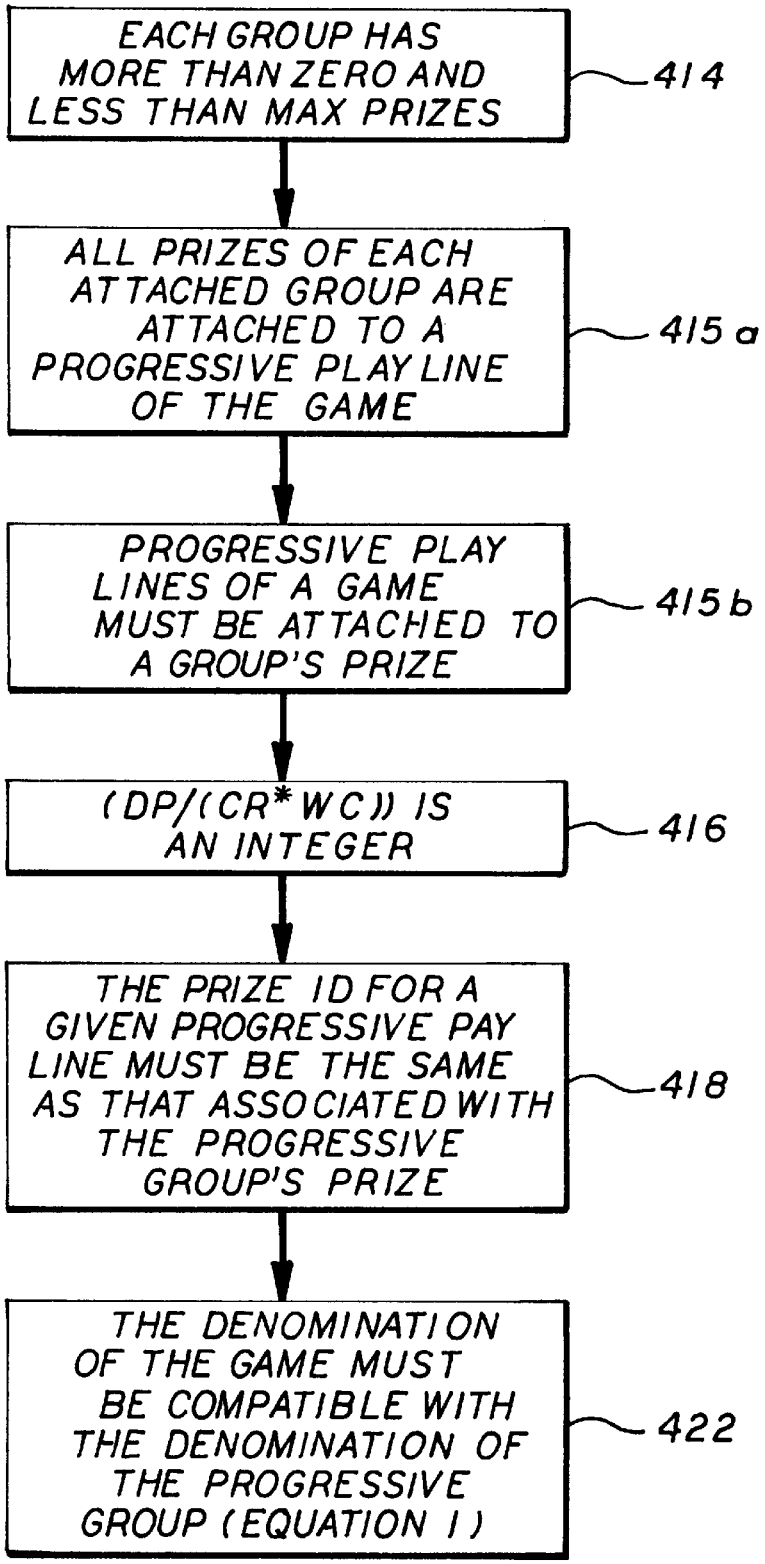
FIG. 4 is a flow chart of a process for data verification upon implementing a new game, according to an embodiment of the present invention.
Figure 5:
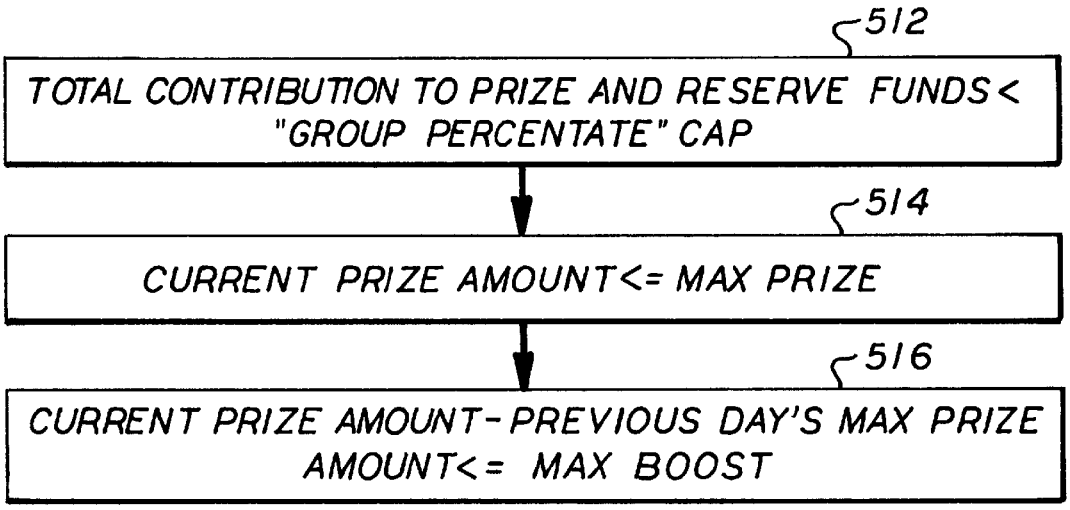
FIG. 5 is a flow chart of a process for data verification during game play according to an embodiment of the present invention.

The various checks 316 that may be performed, according to embodiments of the present invention, to assure that a progressive game has been properly configured, are depicted in FIG. 4. As noted above, it is verified that each group has at least one and no more than a maximum number of prizes 414. All prizes of each attached group are verified as being attached to a progressive pay line of the game 415. And all progressive pay lines of the game must be attached to a group's prize 415*b*. In the depicted embodiment, one of the tests 416 relates to the firmware and hardware used to play the progressive games. This test relates the game type's progressive pay line coin requirements and win cycles (programmed into the game chips) with the "coins to be played" value in the prize type. To ensure a progressive pay line is compatible with the prize type, the prize type's "coins played" value must be an integer multiple of the pay line's "coins required" value (coins required to play times win cycle) 416. By requiring integer compatibility, low denomination games are prevented from playing against high denomination groups. However, high denomination games can be played against low denomination groups. Preventing low denomination games from playing against high denomination groups helps provide for greater profitability per square foot of casino space by promoting high denomination play. Furthermore, preventing low denomination games from playing against high denomination groups insures that contributions to the group are accumulated by "coins." This prevents a contribution to a group prize being a fraction of a cent, which is believed to be a type of accounting particularly disfavored in many regulatory jurisdictions. This is useful because the cluster controllers 105 typically convert the machine's play 106 into group contributions by dividing a delta factor (i.e., the difference since the last poll, in total cents or other denomination played, derived from the machine's "gross cents played" meter) by the group denomination. Check 416 ensures that this division will always result in an integer, thus making the present system advantageous in that it is more likely to be approved by various regulatory agencies, as opposed to a system in which contributions may include fractions of a cent or may be only approximate. Preferably, the checks are configured to assure that if two players place first and second unequal wagers towards a single progressive prize, the two players' odds of winning that prize are exactly (as opposed to only approximately) in proportion to the ratio of the wagers.

Other tests relate primarily to the prize amounts and the cluster controllers that are attached to each group. When a group's prize is attached to a prize type, the prize base amount 232 is derived by multiplying the prize type's coin returned 206 by the group nominal denomination 210. This sets the minimum amount 232 that can be won when the prize is hit. Preferably, the prize ID for a given progressive pay line 208*a* must be the same as that associated with the progressive group's prize 208*b*. This insures the game's "coins played" value 204 and the group's "prize amount" are compatible.

As noted above, the test preferably also includes a determination, using equation (1), that the denomination of the game is compatible with the denomination of the progressive group.

The design of the various checks, such as those depicted in FIG. 4, provide enhanced security, ensuring that the coins played value of a game is compatible with the group's prize amount. Preferably, the system provides great flexibility in activating progressive prizes. Any one game provides for freedom of association between pay lines in group prizes within the limits of compatibility set forth in FIG. 4. This allows for flexibility in designing a group of progressive games where games of different denomination, e.g., can play toward the same progressive game.

FIG. 6 depicts an example of a process implementing the present invention for playing progressive games. At intervals, the cluster controller 105 polls 612 the various gaming terminals 106. In response to the poll, a gaming terminal 106 checks to see if any of the gross cent played (GCP) meters for progressive prizes has changed since the last poll 614. If any have, the current value of a changed GCP is sent to the cluster controller 616.

Preferably, contributions made to a prize are calculated in terms of "coins" rather than in cents (although it is theoretically possible for the "coin" to be a penny), in order to accommodate games with different denominations playing for the same group prize. Accordingly, in the depicted embodiment, the cluster controller reports contributions toward the progressive prize to the central computer in terms of coins rather than in terms of cents. Thus, when the cluster controller receives the gross cents played value from the gaming terminal, it preferably computes the coins played for each group, e.g., using equation 2:

$$\text{coins played} = \frac{CGCP - PGCP}{(GD)} \tag{2}$$

Where "coins played" refers to the number of coins to be reported by the cluster controller to the central system, CGCP refers to the current value of the gross cents played meter, i.e., the value which was reported in response to the most recent poll, PGCP refers to the prior value of the gross cents played meter (i.e., value reported in response to the previous poll, stored in the cluster controller memory) and GD refers to the group denomination 210. By accumulating contributions by coins, games with different denominations are able to play for the same group prize without permitting reporting of fractional cents. For example, the difference between a single play on a 10 cent game versus a single play on a one dollar game, where both games participate in a group having a group denomination of ten cents, would be that the first play would increment the group meter by one coin, while the second play would increment the group meter by ten coins, respectively.

The cluster controller stores 618 a running total of the number of coins played, separately, for each group of which gaming terminal which it controls is a member. At intervals, the cluster controllers 105 are polled by the central system 112, in response to which the cluster controller sends to the central system 620 information indicating the number of coins played for each group for which it is storing play data. The progressive processing engine 118 accumulates 622 the coins played reported by each cluster controller 105 into group meters for each group, i.e., for each progressive game. At intervals, the progressive processing engine 118 broadcasts 624 the current group meter values to the cluster controllers 105 so that prize amounts can be computed, e.g., for display to players or potential players. If the system is a local area progressive (LAP) system, it typically is no purpose in transporting the LAP group meter between the cluster controller and the central system, because the only cluster controller interested in the amount of the increment is the cluster controller which already has that information. Accordingly, in the case of a local area progressive game, contributions are preferably reported to the central system only when a percent change, prize hit or end of day event occurs 620*a*.

As noted, the gaming terminals 106 decide whether to send a GCP meter value for a progressive game based on whether there has been a change in that value since the last poll. If, however, a situation arises in which a gaming terminal 106 sends a GCP value but this value is not properly processed by the cluster controller, the system is in a state in which the central system 112 and cluster controllers 105 have not received the most recent GCP value from one of the terminals. If, at the next poll, the GCP value has not experienced another change, the terminal has no information indicating there was a problem with the last poll, and will not re-send the value which was lost or not processed by the cluster controller. Thus, for at least a certain window of time, a machine malfunction could potentially cause a contribution to be lost. This is particularly problematic when the values for gross cents from various terminals stored in the cluster controllers 105 are "frozen" (referred to as placing a group in a "marked condition"). When a group is in a marked condition, gross cents played values for the group in each of the cluster controller are frozen or prevented from changing because, in this condition, the group GCP values in the cluster controllers must be sent with the last coins played values computed from them to the central system 112. Various events may occur which result in placing the group in a frozen or marked condition. The marked condition is instituted in response to (1) an "end of day" command (described below) which is used to instruct the cluster controllers to gather full meters, synchronize them with the GCPs and compute final contributions; (2) a "mark group" message, which is used to instruct the cluster controllers to synchronize the GCPs with a final contribution (this message is used, e.g., when certain game data is being changed such as a contribution percentage factor or other contribution sensitive data); (3) a "prize reset" message which is sent when it occurs in the system, instructing the cluster controllers to reset a prize amount and synchronize the GCPs with a final contribution.

Preferably, the CC is configured to continue processing GCP meters from the machine during the time they are in a marked state. In one embodiment, the CC builds a storage area 904 for each progressive game's GCP meter 902 (CC's Game GCP) and also one for each group attached to the game (Group n GCP) 906*a*, 906*b*. The Group Coin Played Accumulators (Group n CP) 908*a*, 908*b* are established as one per group regardless of the number of games attached to the group. Every time a machine reports a GCP meter 902, or fall machine meters are collected, the game GCP meter is saved in the CC's Game GCP 904. Usually there is no marked group condition in force when the CC's Game GCP 904 is updated, any Group GCPs 906*a*, 906*b* are updated and coins played is computed and accumulated into the Group Coin Played Accumulators 908*a*, 908*b*.

The CC processes a Mark Meter event slightly differently from the Mark Group and Prize Reset event. This is because the Mark Meter event requires the progressive GCP meter values to be the same as the GCP meter value in each of the full machine meters so that the progressive processes can be balanced with the accounting processes. The Mark Group and Prize Reset events are only concerned with progressive GCP values so the CC processes these events with the data it has in memory. Once the Mark Meter process has synchronized the CC's Game GCP values 904 with the full machine meter values, the processes are the same as far as the mark group condition is concerned.

Figure 9:
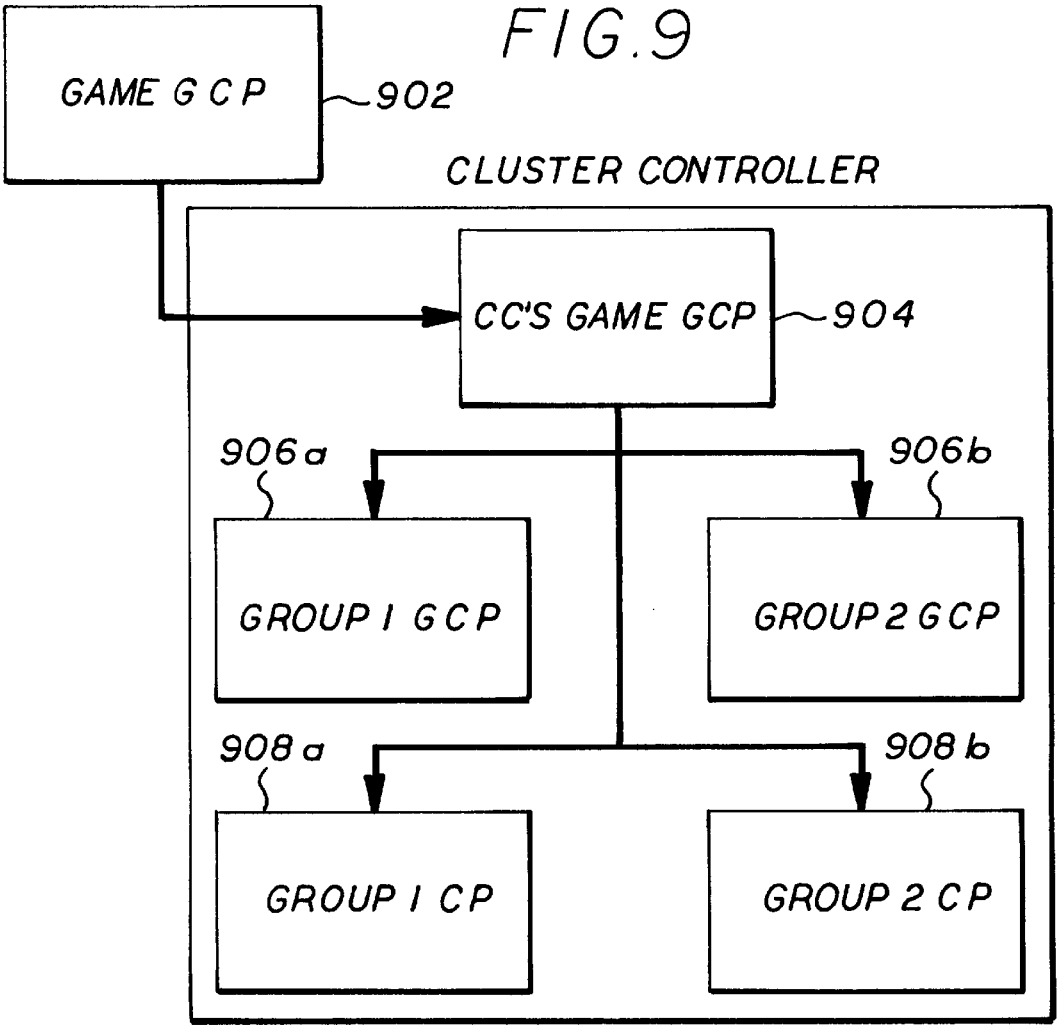
FIG. 9. is a block diagram showing an example of a memory structure in a cluster controller for handling marked group situations according to an embodiment of the present invention.

To explain the process used by the CC to continue processing GCP values from the machine while a group is marked, FIG. 9 illustrates an example in which two groups are attached to one game. As a GCP value 902 is received it normally updates all the Group GCP 906*a*, 906*b* values, the deltas are computed and used to update the Group Coin Played Accumulators 908*a*, 908*b*. If one of the groups, Group 1, is in a marked group condition when the GCP value is received from the machine, the processing for Group 2 is the same. But, because Group 1 is in a marked condition, no processing takes place. As long as the group is marked, the Game GCP 902 will only update the CC's Game GCP area 904. This ensures that the contributions reported from the Group Cons Played Accumulator are synchronized with the Group GCP values reported for the group while the group is in the marked group condition.

When the group leaves the marked group condition, the CC updates the group's GCP 906*a* and Group Coins Played Accumulator 908*a* values from the CC's Game GCP's 904 current value. This ensures that even though play occurred on the machine during the marked group condition, the play will be recorded to the group data after the group leaves the marked group condition.

In response to receiving the broadcast of group meter values, the cluster controllers manage the calculation and display of the prize amounts 626. In addition to the group meter value (GM) which was broadcast to the CC's, the cluster controllers also have access to additional data used for computing the current prize amount. Additional data can include the base amount plus the offset amount (DO), the starting group meter (SGM) which is the value of the group meter used to compute the contribution amount. The denomination and contribution percent (DP) is the product of the group's denomination 210 and the prize's contribution percent 222. The maximum prize amount (MPA) is the lower of the maximum prize 238 and the daily maximum prize amount (computed using the maximum boost value 242). SGM, BO, DP and MPA preferably are maintained in the central system 112 and broadcast to the cluster controllers whenever those values change.

At intervals, preferably at the end of each poll cycle, the cluster controllers compute the current prize amount for every prize group. In one embodiment, the current prize amount is computed according to equation 3:

$$PA=BO+(GM-SGM+LC)*DP \quad (3)$$

Where LC is equal to the local contribution not yet sent to the system (the group coins played accumulator). If the prize amount (PA) is less than the maximum prize amount (MPA), then the (PA) value is transmitted to the gaming terminals 106 and/or other display devices for display to players or potential players. Otherwise, the maximum prize amount (MPA) is sent. Thus, the amount that will be displayed is the lower of the computed prize amount (PA) and the maximum prize amount (MPA). If a prize hit occurs the winner is paid the displayed amount (the lower of PA and MPA). If the amount paid is less than PA, then the difference between the computed prize amount (PA) and the paid amount is put into the prize offset amount and contributed toward the next prize for that game.

As discussed above, a win event can be initiated by any of a number of items such as passage of time, random generation of win events, or other manually or automatically generated events 702. In FIG. 7A, a first procedure 704 shows a win event which is automatically generated by a win of a progressive game event at a gaming terminal, e.g., a particular alignment of slot machine reel symbols which has been predefined as a progressive game win. Procedure 706 shows manual generation of a progressive win or hit (e.g., by entering a hit command to the central system using a keyboard).

In procedure 704, after the gaming terminal detects the prize win, it formulates a "prize hit" message and sends this message to the cluster controller 105 in response to the next poll which is transmitted from the cluster controller 708. The cluster controller then formulates all prize hit messages which it has received and sends these 710 to the TPE 116 in response to the next poll which is received from the front end controller (CFE) 126.

Procedure 706 can be used in a number of situations, e.g., when a progressive prize hit has occurred but the proper message is not being sent to the TPE in the normal fashion (e.g., the normal communication lines 132 are inoperative). In this case, the casino personnel may notify 712 a central system operator (e.g., by telephone) who then inputs the hit information 716 to the central system 112 manually through the user interface 122 (e.g., a keyboard).

Regardless of where the prize hit message originates, procedures are then followed in both the remote locations, e.g., in the cluster controllers 105 and in the central system 112. In the remote system, e.g., the cluster controller, sends a disable message to the machine that reported the prize hit and requests the EEPROM signature 724 (i.e., an electronic characterization or description of the EEPROM in each particular gaming terminal which is unique to that gaming terminal) and the machine responds with the EEPROM signature. The cluster controller determines whether that signature is valid 726, e.g., by comparing it with valid signatures stored in memory. If the signature is invalid, a security event, preferably a high priority (Class 4) event message is formulated and sent to the TPE 728. This message invalidates the prize win. However, the central system will typically have already started processing the prize hit and may have completed prize hit processing and proceeded to start a new game. In this situation the gaming jurisdiction will intervene and manually address the validity of the jackpot hit. If the signature is valid, the cluster controller sends a "reset permission" message to the winning machine to allow it to play after it has been manually reset and enabled, e.g., by the user interface (UIF) operator 732.

Once a prize message is received by the TPE, it will send a prize reset message to each CC running on the group. When the cluster controller receives the prize reset message, it broadcasts the prize reset amount to each machine 745. Machines in an enabled condition will receive the prize reset message and display the reset amount. The cluster controller will not broadcast another prize amount for the prize until the prize hit processing is complete and the group is unmarked.

When the TPE 116 receives the prize hit information, it places the group 134 containing the winning machine in a marked condition 736. The TPE then compares this win to a stored prize history file. If there is a group prize hit for the same amount on the same machine and game in a predetermined period 738, such as in the last N days (N may be, e.g., 1 days, 2 days, 3 days, etc.) the TPE formats a "duplicate prize event" message and drops the prize hit message, closing the prize hit process 742. If there has not been a duplicate hit, this event is added to the prize history fie 744. The system determines 746 whether this is a primary prize hit (e.g., by consulting a prize number 226 for this prize) and, if so, determines 748 whether the secondary prize is to be paid whenever there is a primary prize hit (e.g., by consulting the Group Table Secondary pay flag 285). If so, a second prize hit message is generated for the secondary prize 752 and a secondary prize hit message is re-routed to the beginning of the procedure 722 to follow the primary message throughout the process.

There are a number of situations in which multiple progressive prize hits for a given prize can occur. For example, at the time a prize hit occurs, the TPE receives the message through its communications with the CFEs 126. Each CFE operates on a poll cycle basis with independent processes for each port and, as depicted in FIG. 1, there is typically more than one CFE. Thus, it is possible for there to be several prize hits which occur in the time span between the period just prior to the first message being detected by the TPE and just after the prize hit has been processed. If processing of the previous prize hit information is already completed 756, normal prize processing and award of the current prize is completed and the group is unmarked. A prompt message is sent to the CC's to reactivate the machines 758. However, if the current hit being processed was received before the end of processing of the previous hit, it is determined whether the reported prize for the current hit is equal to the prize reset value 762. If not, then the prize winner creates a multiple winner situation for the prize hit processing. The only way the reported prize amount can be unequal to the prize reset is if the machine was in the process of a prize hit when the prize reset was broadcast by the cluster controller. In this case, the machine would ignore the prize reset message until it is manually reset. Multiple winners of one prize are processed manually 764 depending on the setting of a multiple prize winner flag 288 associated with the prize. If a reported prize amount is equal to the prize reset, then the prize winner receives the prize reset value only 766, the prize award process is completed in the normal fashion and the group is unmarked. In this case there is no final contribution accumulation required. The case of multiple reset prize winner will also be handled the same way as described for multiple prize hits.

In the embodiment of FIG. 8, when it is desired to change the parameters of one of the progressive games, e.g., by changing the percentage contribution 222, base amount 232, base reset 236, etc., this process is initiated by manually inputting 802, i.e., via keyboard, the desired percentage changes to the database processor 113*c*. The following processes involve coordination of procedures 804, 806 which are performed by the central system 112 and the remote devices, such as via cluster controllers 105. In the depicted embodiment, the database processor 120 sends a "percent change" message to the TPE 808. The TPE then sends a "mark group" message to all cluster controllers that are running gaming terminals in the group associated with the progressive prize that is being changed 812. The various cluster controllers acknowledge receipt of this message and place the terminals in this group in a marked condition 814. After receiving acknowledgment from the cluster controllers, the TPE then has information indicating that the cluster controller has the final contributions synchronized with the gross cents played amounts. The TPE then sends the "group meters and contribution" request message to the cluster controllers 816. In response, the cluster controllers send to the TPE the values of their group meters and contributions 818. When the TPE receives all the group meter and contribution data responses, it computes new reserve balances and group prize offset amounts. In one embodiment, these values are computed using equations 4 and 5:

$$O_{new}=((GM-SGM)*D*P)+O_{old} \quad (4)$$

$$B_{new}=((GM-SGM)*D*RP)+B_{old} \quad (5)$$

Where:

O equals the group's prize offset amount.

B equals the group's reserve balance.

GM equals the group meter value.

SGM equals the starting group meter value.

D equals the denomination for the group 210.

P equals the contribution percent 222.

RP equals the contribution percent applied to the reserve balance.

If the prize hit was for the primary prize, and the "pay secondary on primary" flag is set, the TPE resets the starting group meters and the group meter value to zero for all prizes. If it is a primary prize hit and the "pay secondary" flag is not set, then the TPE computes the current prize amount for the secondary and other level prizes and adds the computed amounts to the prize offset amounts of the respective prizes. It then resets the starting group meters and the group meter value for all prizes to zero. If on the other hand this was a secondary prize hit or prize hit of levels other than the primary prize hit, the TPE resets the starting group meter of the secondary prize or other prize level to the group meter value without disturbing the starting group meter for the other prizes.

In an initial portion of the procedure 826, if a prize hit occurred, this prize hit would have preempted the percent change processing of FIG. 8 and taken over the final contribution and collections for use in processing the prize. At predetermined time intervals, the process checks to determine if all the cluster controllers have reported contributions 818. When they have all reported (or when the cluster controllers are not communicating), the percent change process continues until all files needed to record the percent change have been output. If a prize hit occurs after the initial portion 826, a prize hit flag is set. The TPE waits 827 until all cluster controllers have acknowledged the new configuration 828, and then sends a "unmark group" command to the cluster controllers 832. In response to the "unmark group" command, the cluster controllers unmark the groups 836 and the process is complete. If the prize hit flag is set, prize hit processing (FIG. 7) immediately begins. The prize hit processing then initiates another mark group—GCP collection-prize configuration-unmark group sequence as described earlier.

In previous progressive systems, various accounting/reporting periods were defined in order to assure that various funds received and disbursed were accounted for, balanced and verified. For example, in some systems, an "end of day" accounting activity would take place every 24 hours. Although it is possible to define a similar "end of day" activity which will occur every time a progressive prize hit or win occurs, this is believed to quickly become unwieldy when there are two or more progressive prize groups being processed on the same central system. Accordingly, in one embodiment of the present invention, there are at least two separate types of accounting or balancing activities, a first activity that takes place on a periodic basis, such as daily "end of day" accounting, and a second type of accounting or balancing which is triggered by a prize hit. As noted above, each gaming terminal which participates in a progressive game stores information about the total value of bets or wagers placed on a progressive game in a gross cents played (GCP) meter. The first type of accounting process gathers information from the gross cents played meter (and, if desired, other meters that may be maintained in the gaming terminals), whenever (1) a machine is enabled, (2) a machine is disabled, (3) at end of day. When the end of day accounting meters are gathered by the cluster controllers, the cluster controller obtains the GCP meters from the accounting meter data. The CC sends the GCPs to the central system in a separate poll process from accounting meters so that the progressive end of day is not impacted by the RTS's (relatively slow) process of collecting the full account meters from all machines.

The second type of accounting process is initiated when there is a prize hit or a percent change. In either of these events, the GCP is collected (744, FIG. 7); 818 FIG. 8. Once the accounting meters are collected by the real time system 114, they are sent to the database processor 120 for accounting procedures. The database processor 120 computes the net activity of each machine and game by subtracting the last meter values gathered from the current meter values. This data is used for computing taxes, fees and other assessments and for billing retailers as needed.

Theoretically, the data gathered from the GCPs in response to various events (end of day, prize hit, or percentage change) will balance with the information regarding amount of play which is gathered in the normal course of process when contributions are accumulated (616, 620, 622; FIG. 6). However, if a cluster controller sends contribution information to the central system and then goes into a non-responding mode during processing of a hit (or other event), the GCP meters for terminal or cluster controller will not be available for verifying the increment to the group meter. To enable isolating the contributions for machines that are non-responding during event processing, the central system maintains a set of accumulators for each group and cluster controller relationship. Every time contributions are received by the central system they are added to both the group meter and the cluster controller group total. An event starts the process of gathering GCPs, the central system calculates the difference between the last GCP for a game and group, computes the number of coins the difference represents, and subtracts the coins from the cluster controller group total. If there were non-responding machines, the CC group total would represent the coins reported by the CC that went into the group meter. The data processor 120 verifies contributions by comparing the last GCP values for each game with the current one. Differences are converted into coins and summed by cluster controller and by group. The current value is verified using equation 6:

$$\frac{\text{sum of any differences for all } GCP\text{'s}}{\text{* Group Denomination}} + \text{sum of } CC \text{ Group totals} = \text{Group Meter Value} \quad (6)$$

If there is any situation in which an instance of equation 6 is not an equality, there is a error in the way the PRG is accumulating contributions or the way the database 120 procedures are verifying the data.

As noted above, the end of day balancing process 1001 (FIG. 10) is separate from the event-to-event balancing process. The purpose of the end of day processing is to gather the machine meters from all machines and, for those machines that have been attached to a progressive game, coordinating the final contributions with the machine meters for balancing between the accounting and progressive processes. At the beginning of an "end of day" procedure, the central system sends a "mark group" command to the cluster controllers 1012, and every group on all cluster controllers are brought into the "mark group" state. In contrast, a prize hit or a percent change event results in processing GCPs only for the single group experiencing that event. The cluster controllers gather machine meters from the various gaming terminals in the group 1014. If any gaming terminal fails to respond, the meters currently in the cluster controller's memory are marked and the non-responding flag is set for that machine 1016. After all meters have been gathered, cluster controllers send a "meters ready" message to the central system 1018. At this time, typically the gross cents played meters for each game playing a progressive will be the same as the gross cents played meter in the machine meter's record. The only exceptions will be machines that did not respond. Variances arising from non-response can be detected during the end-of-day process and appropriately reported. In response to a "ready" message, the TPE sends a "group meters and contribution request" message to each group on the CC 1020. The CC responds with the group meter and contribution data for each group request 1022.

Once all contributions have been collected for a group 1024, the central system will perform the progressive end of day calculations 1026. If a prize hit has occurred while the group was in the mark group state or end of day processing 1028, the prize hit flag will be set 1030. In this case, the prize process will be started in order to process the prize hit using the GCPs collected by the end-of-day process 1032. Otherwise the central system will send the cluster controllers an "unmarked group" command 1034 and the cluster controller will acknowledge this message and begin with normal contribution polls for the group 1036. This ends the progressive end-of-day processing. Other meters used for other types of accounting may be processed at this time if desired 1038. In one embodiment, as part of the additional processing, the cluster controllers provide a manufacturer ID and machine serial number as part of an accounting meter record, and this is compared with data stored in the database processor 120, with an exception being generated if there is a difference.

In one embodiment, before groups are unmarked, the central system computes a new daily maximum total for each group. In one embodiment, as part of the end-of-day process, the current value of the group meter is checked against a maximum capacity and if the current value is within a percentage factor of the maximum, rollover processing is done to handle a situation in which the capacity of a group meter has been exceeded and the meter has rolled over to zero.

When it is desired to deactivate a group, one process that can be used is to reset the base amount and all contribution percentage factors to zero and, once the last prize is hit, to deactivate all machines in the group.

A number of variations and modifications of the invention can be used. It is possible to use some aspects of the invention without using others. For example, it is possible to provide for multiple games and multiple denominations on a single central system without providing for freedom of association between prizes and games. The level of contribution tracking may be at the game level, the machine level, the site or owner level. In some cases, the reserve fund may be allowed to have a negative value, in effect allowing current play to fund a previous prize amount. If desired, the base amount of a prize can be set at a level which is greater than the jurisdiction-approved amount, e.g., in order to generate interest in the games. In one embodiment, if a prize is won and the amount to be paid is greater than either the "current maximum prize amount" or the "maximum prize amount allowed," preferably the lowest of "today's maximum prize amount" or the "maximum prize amount" is paid, with the difference going into an offset amount for the next prize.

In light of the above description, a number of advantages of the present invention can be seen. The present invention provides the ability to run many progressive prizes on one central system. In the present invention the restriction, found in previous systems, of forcing machines to have the same odds and amount bet has been removed. In the present invention, a new event trigger definition allows the hit of a progressive prize to be created by an event unrelated to any particular game logic. The present system provides accounting which is precise rather than approximate and permits accounting in terms of whole monetary units, such as cents, rather than fractions thereof. The present invention provides for flexibility, e.g., in the number of progressive games run on a single system, denominations of gaming terminals and games, number of prizes per progressive game, etc., without undue complexity. The system provides built-in protection to prevent or reduce the impact from risks of system corruption from hardware or software failure or operator error or cheating. Database relationships are built in such a fashion that only valid relationships are provided.

Although the present invention has been described by way of a preferred embodiment and certain variations and modifications, other variations and modifications can also be used, the invention being defined by the following claims.

What is claimed is:

1. A progressive gaming system comprising:

a central computer coupled, at least indirectly, to gaming terminals each of which is coupled to a notification device for indicating the win of a progressive prize;

a first plurality of said gaming terminals being eligible for a first progressive prize, based on first contributions from said first plurality of gaming terminals;

a second plurality of said gaming terminals being eligible for a second progressive prize, based on second contributions from said second plurality of gaming terminals;

said central computer receiving information regarding said first contributions and transmitting information, when said first progressive prize has been won, to indicate a win using said notification device coupled to one of said first plurality of gaming terminals; and said central computer receiving information regarding said second contributions and transmitting information, when said second progressive prize has been won, to indicate a win using said notification device coupled to one of said second plurality of gaming terminals;

wherein the same said central computer calculates both the amount of said first progressive prize, when said first progressive prize has been won, and the amount of said second progressive prize, when said second progressive prize has been won.

2. A progressive gaming system, as claimed in claim 1, wherein said first and second pluralities of gaming terminals have at least one gaming terminal in common.

3. A progressive gaming system, as claimed in claim 1, further comprising a cluster controller which receives contribution information from at least some of said first plurality of gaming terminals and transmits said information regarding said first contributions to said central computer.

4. A progressive gaming system as claimed in claim 1 wherein said central computer stores an indication of the value of at least a first group denomination associated with said first progressive prize, and wherein said information regarding said first contributions indicates integral multiples of said first group denomination.

5. A progressive gaming system as claimed in claim 1 wherein each of said first plurality of gaming terminals requires a minimum wager for participation in a game which is eligible for said first progressive prize and wherein at least one of said first plurality of gaming terminals has a minimum wager different from the minimum wager of at least another of said first plurality of gaming terminals.

6. A progressive gaming system, as claimed in claim 1, wherein said central computer is configured to retrieve progressive gaming information from a database, wherein said progressive gaming information includes first odds information relating to odds of winning said first progressive prize and second odds information relating to odds of winning said second progressive prize.

7. A progressive gaming system comprising a central computer coupled, at least indirectly, to gaming terminals each of which is coupled to a notification device for indicating the win of a progressive prize;

a first plurality of said gaming terminals being eligible for a first progressive prize, based on first contributions from said first plurality of gaming terminals;

a second plurality of said gaming terminals being eligible for a second progressive prize, based on second contributions from said second plurality of gaming terminals;

said central computer receiving information regarding said first contributions and transmitting information, when said first progressive prize has been won, to indicate a win using said notification device coupled to one of said first plurality of gaming terminals; and said central computer receiving information regarding said second contributions and transmitting information, when said second progressive prize has been won, to indicate a win using said notification device coupled to one of said second plurality of gaming terminal;

wherein each of said first plurality of gaming terminals, following play on said gaming terminal, provides an output indicative of a result of said play;

wherein said central computer repeatedly receives, stores or transmits information indicative of a decision as to whether said first progressive prize has been won; and wherein said decision is independent of said result of play in any of said first plurality of gaming terminals.

8. A progressive gaming system as claimed in claim 7 wherein a decision that said first progressive prize has been won is made only after passage of a randomly selected time duration following a predetermined event.

9. A progressive gaming system as claimed in claim 7 wherein a decision that said first progressive prize has been won is made only after an event selected from the group consisting of a push of a button, a predetermined result from a spin of a wheel of fortune, and a draw of a predetermined token from a plurality of tokens.

10. A progressive gaming system a central computer coupled, at least indirectly, to gaming terminals each of which is coupled to a notification device for indicating the win of a progressive prize;

a first plurality of said gaming terminals being eligible for a first progressive prize, based on first contributions from said first plurality of gaming terminals;

a second plurality of said gaming terminals being eligible for a second progressive prize, based on second contributions from said second plurality of gaming terminals;

said central computer receiving information regarding said first contributions and transmitting information, when said first progressive prize has been won, to indicate a win using said notification device coupled to one of said first plurality of gaming terminals; and said central computer receiving information regarding said second contributions and transmitting information, when said second progressive prize has been won, to indicate a win using said notification device coupled to one of said second plurality of gaming terminals;

wherein said central computer is configured to retrieve progressive gaming information from a database, wherein said progressive gaming information includes first odds information relating to odds of winning said first progressive prize and second odds information relating to odds of winning said second progressive prize;

wherein said central system is configured to perform at least a first check to detect errors in information stored in said database, relating to a progressive game, before said progressive game is first played.

11. A progressive gaming system as claimed in claim 10 wherein said database is used to store at least a coins to be played value, a coins required value and a win cycle value and wherein said first check is a check to assure that the coins to be played value divided by the product of the coins required value times the win cycle value is an integer.

12. A progressive gaming system as claimed in claim 10 wherein said database is used to store at least a coins to be played value, a coins required value, a win cycle value, a coins return value, a group denomination value and a game denomination value and wherein said first check is a check to assure that the integer produced by the relationship of game type to prize type times the group denomination value equals the game denomination value.

13. A progressive gaming system as claimed in claim 10 wherein each of said first and second pluralities of gaming terminals has an acceptable denomination, said database is used to store game denomination values associated with each of said first and second pluralities of gaming terminals and group denomination values associated with each of said first and second progressive prizes, and wherein said first check is a check to assure the game denomination values associated with each of said first plurality of gaming terminals is equal to or greater than the group denomination value associated with for said first progressive prize and the game denomination values associated with each of said second plurality of gaming terminals is equal to or greater than the group denomination value associated with for said second progressive prize.

14. A progressive gaming system as claimed in claim 13 wherein at least one of said first plurality of gaming terminals is associated with a game denomination value which is equal to or greater than the group denomination value associated with said first progressive prize.

15. A progressive gaming system comprising:

a central computer coupled to a plurality of gaming terminals which are eligible for at least one chance at least a first progressive prize to be awarded according to a predetermined odds of winning, wherein said predetermined odds is established such that, on average, a first number of coins are played between consecutive wins of the progressive prize;

at least a first of said plurality of gaming terminals configured to initiate at least one chance at said first progressive prize in response to reception of at least a first minimum number of coins of a first denomination, and a handle pull, and wherein said first gaming terminal is configured such that, on average, a first number of handle pulls are received between consecutive prizes;

at least a second of said plurality of gaming terminals configured to initiate at least one chance at said first progressive prize in response to reception of at least a second minimum number of coins of a second denomination, different from said first denomination, and a handle pull and wherein said second gaming terminal is configured such that, on average a second number of handle pulls are received between consecutive prizes;

wherein said first number of coins on average between wins divided by the product of said first minimum number of coins and said first number of handle pulls is an integer; and wherein said first number of coins on average between wins divided by the product of said second minimum number of coins and said second number of handle pulls is an integer.

16. A method for providing a progressive gaming system implemented using central computer coupled, at least indirectly, to gaming terminals each of which is coupled to a notification device for indicating the win of a progressive prize, the method comprising;

receiving, in said central computer, first information indicating contributions towards a first progressive prize from a first plurality of said gaming terminals eligible for said first progressive prize;

receiving, in said central computer, second information indicating contributions towards a second progressive prize from a second plurality of said gaming terminals eligible for said second progressive prize;

transmitting from said central computer, when said first progressive prize has been won, information for activating at least one notification device coupled to one of said first plurality of gaming terminals; and transmitting from said central computer, when said second progressive prize has been won, information for activating at least one notification device coupled to one of said second plurality of gaming terminals.

17. A method, as claimed in claim 16, wherein said first and second pluralities of gaming terminals have at least one gaming terminal in common.

18. A method, as claimed in claim 16, further comprising:

receiving, in a cluster controller, contribution information from at least some of said first plurality of gaming terminals and transmitting said information regarding said first contributions from said cluster controller to said central computer.

19. A method as claimed in claim 16 further comprising:

storing, by said central computer, an indication of the value of at least a first group denomination associated with said first progressive prize, and wherein said information regarding said first contributions indicates integral multiples of said first group denomination.

20. A method as claimed in claim 16 wherein each of said first plurality of gaming terminals requires a minimum wager for participation in a game which is eligible for said first progressive prize and wherein at least one of said first plurality of gaming terminals has a minimum wager different from the minimum wager of at least another of said first plurality of gaming terminals.

21. A method, as claimed in claim 16 further comprising:

retrieving, by said central computer, progressive gaming information from a database, wherein said progressive gaming information includes first odds information relating to odds of winning said first progressive prize and second odds information relating to odds of winning said second progressive prize.

22. A method as claimed in claim 16 further comprising:

providing output, by each of said first plurality of gaming terminals, following play on said gaming terminal, indicative of a result of said play; and repeatedly transmitting information to said central computer indicative of a decision as to whether said first progressive prize has been won wherein said decision is independent of said result of play in any of said first plurality of gaming terminals.

23. A method as claimed in claim 22 wherein a decision that said first progressive prize has been won is made only after passage of a randomly selected time duration following a predetermined event.

24. A method, as claimed in claim 22 wherein a decision that said first progressive prize has been won is made only after an event selected from the group consisting of a push of a button, a predetermined result from a spin of a wheel of fortune, and a draw of a predetermined token from a plurality of tokens.

25. A method for providing a progressive gaming system implemented using central computer coupled, at least indirectly, to gaming terminals each of which is coupled to a notification device for indicating the win of a progressive prize, the method comprising:

receiving, in said central computer, first information indicating contributions towards a first progressive prize from a first plurality of said gaming terminals eligible for said first progressive prize;

receiving, in said central computer, second information indicating contributions towards a second progressive prize from a second plurality of said gaming terminals eligible for said second progressive prize;

transmitting from said central computer, when said first progressive prize has been won, information for activating at least one notification device coupled to one of said first plurality of gaming terminals;

transmitting from said central computer, when said second progressive prize has been won, information for activating at least one notification device coupled to one of said second plurality of gaming terminals; and performing, in said central system, at least a first check to detect errors in information stored in said database, relating to a progressive game, before said progressive game is first played.

26. A method as claimed in claim 25 wherein said database is used to store at least a coins to be played value, a coins required value and a win cycle value and wherein said first check is a check to assure that the coins to be played value divided by the product of the coins required value times the win cycle value is an integer.

27. A method as claimed in claim 25 wherein said database is used to store at least a coins to be played value, a coins required value, a win cycle value, a coins return value, a group denomination value and a game denomination value and wherein said first check is a check to assure that the integer produced by the relationship of game type to prize type times the group denomination value equals the game denomination value.

28. A method as claimed in claim 25 wherein each of said first and second pluralities of gaming terminals has an acceptable denomination, said database is used to store game denomination values associated with each of said first and second pluralities of gaming terminals and group denomination values associated with each of said first and second progressive prizes, and wherein said first check is a check to assure the game denomination values associated with each of said first plurality of gaming terminals is equal to or greater than the group denomination value associated with for said first progressive prize and the game denomination values associated with each of said second plurality of gaming terminals is equal to or greater than the group denomination value associated with for said second progressive prize.

29. A method as claimed in claim 28 wherein at least one of said first plurality of gaming terminals is associated with a game denomination value which is greater than the group denomination value associated with said first progressive prize.

30. Apparatus for providing a progressive gaming system implemented using a central computer coupled, at least indirectly, to gaming terminals each of which is coupled to a notification device for indicating the win of a progressive prize, the apparatus comprising:

means, in said central computer, for:

receiving, first information indicating contributions towards a first progressive prize from a first plurality of said gaming terminals eligible for said first progressive prize; and receiving, second information indicating contributions towards a second progressive prize from a second plurality of said gaming terminals eligible for said second progressive prize; and means, in said central computer, for:

transmitting from said central computer, when said first progressive prize has been won, information for activating at least one notification device coupled to one of said first plurality of gaming terminals; and transmitting from said central computer, when said second progressive prize has been won, information for activating at least one notification device coupled to one of said second plurality of gaming terminals.

* * * * *

US005885158C1

(12) EX PARTE REEXAMINATION CERTIFICATE (6274th)

United States Patent
Torango et al.

(10) Number: US 5,885,158 C1
(45) Certificate Issued: Jun. 24, 2008

(54) GAMING SYSTEM FOR MULTIPLE PROGRESSIVE GAMES

(75) Inventors: Lawrence J. Torango, Reno, NV (US); Kumar Kannan, Reno, NV (US); Mark Lowell, Reno, NV (US); Bhavani Prasad, Reno, NV (US); Wayne Seguin, Reno, NV (US); Rick Rowe, Reno, NV (US); Adrian Marcu, Reno, NV (US)

(73) Assignee: IGT, Reno, NV (US)

Reexamination Request:
No. 90/006,655, May 29, 2003
No. 90/007,212, Sep. 20, 2004

Reexamination Certificate for:

| | |
|---|---|
| Patent No.: | **5,885,158** |
| Issued: | **Mar. 23, 1999** |
| Appl. No.: | **08/716,823** |
| Filed: | **Sep. 10, 1996** |

Related U.S. Application Data

(60) Provisional application No. 60/600,670, filed on Feb. 13, 1996.

(51) Int. Cl.
*A63F 9/24* (2006.01)

(52) U.S. Cl. ..... 463/27
(58) Field of Classification Search ..... 463/27
See application file for complete search history.

(56) References Cited

U.S. PATENT DOCUMENTS

| | | | | |
|---|---|---|---|---|
| 3,998,309 A | | 12/1976 | Mandas et al. | |
| 4,072,930 A | | 2/1978 | Lucero et al. | |
| 4,238,127 A | | 12/1980 | Lucero et al. | |
| 4,283,709 A | | 8/1981 | Lucero et al. | |
| 4,335,809 A | | 6/1982 | Wain | |
| 4,409,656 A | | 10/1983 | Andersen et al. | |
| 4,494,197 A | | 1/1985 | Troy et al. | |
| 4,573,681 A | | 3/1986 | Okada | |
| 4,636,951 A | | 1/1987 | Harlick | |
| 4,652,998 A | | 3/1987 | Koza et al. | |
| 4,669,731 A | * | 6/1987 | Clarke | 463/20 |
| 4,760,527 A | | 7/1988 | Sidley | |
| 4,805,907 A | | 2/1989 | Hagiwara | |
| 4,837,728 A | * | 6/1989 | Barrie et al. | 463/27 |
| 4,842,278 A | | 6/1989 | Markowicz | |
| 4,856,787 A | | 8/1989 | Itkis | |
| 4,871,171 A | | 10/1989 | Rivero | |
| 4,880,237 A | | 11/1989 | Kishishita | |
| 4,926,327 A | | 5/1990 | Sidley | |
| 4,964,638 A | * | 10/1990 | Ishida | 463/27 |
| 5,038,022 A | | 8/1991 | Lucero | |
| 5,048,833 A | | 9/1991 | Lamle | |
| 5,116,055 A | * | 5/1992 | Tracy | 463/27 |
| 5,123,649 A | | 6/1992 | Tiberio | |

(Continued)

FOREIGN PATENT DOCUMENTS

AU 39363/78 8/1978

(Continued)

OTHER PUBLICATIONS

Fey, Slot Machines, A Pictorial History of the First 100 Years, Liberty Belle Books, 1983, p. 153.*

(Continued)

*Primary Examiner*—Jeffrey R Jastrzab

(57) ABSTRACT

A progressive gaming system is configured to run many progressive prizes on one central system. The relationship between progressive group and prize with a particular game is designed so that the odds and bet on a particular game need not be identical throughout a group. In one embodiment, prize definition is in terms of number of coins expected to be played between prize hits, independent of denomination, and minimum number of coins returned to players, regardless of odds or denominations. When a progressive game is designed, the coins bet and odds related to the logic of the game are verified as compatible with the prize definitions coins expected to be played between prize hits. The prize definition is used to validate an association between a particular game and a particular progressive prize. Preferably the event that triggers a progressive prize may be unrelated to the events on any game.

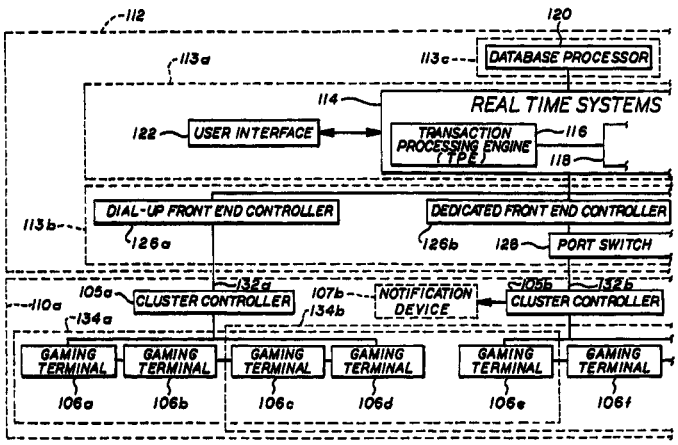

U.S. PATENT DOCUMENTS

| | | | | | |
|---|---|---|---|---|---|
| 5,217,224 | A | | 6/1993 | Sincock | |
| 5,259,616 | A | | 11/1993 | Bergmann | |
| 5,275,400 | A | | 1/1994 | Weingardt et al. | |
| 5,280,909 | A | * | 1/1994 | Tracy | 463/27 |
| 5,286,023 | A | | 2/1994 | Wood | |
| 5,321,241 | A | | 6/1994 | Craine | |
| 5,324,035 | A | | 6/1994 | Morris et al. | |
| 5,326,104 | A | | 7/1994 | Pease et al. | |
| 5,342,049 | A | | 8/1994 | Wichinsky et al. | |
| 5,344,144 | A | * | 9/1994 | Canon | 463/27 |
| 5,351,970 | A | | 10/1994 | Fioretti | |
| 5,393,057 | A | | 2/1995 | Marnell, II | |
| 5,398,932 | A | | 3/1995 | Eberhardt et al. | |
| 5,401,024 | A | | 3/1995 | Simunek | |
| 5,423,539 | A | | 6/1995 | Nagao | |
| 5,429,361 | A | | 7/1995 | Raven et al. | |
| 5,470,079 | A | | 11/1995 | LeStrange et al. | |
| 5,476,259 | A | | 12/1995 | Weingardt | |
| 5,524,888 | A | | 6/1996 | Heidel | |
| 5,544,893 | A | | 8/1996 | Jones et al. | |
| 5,547,192 | A | | 8/1996 | Ishibushi | |
| 5,560,603 | A | * | 10/1996 | Seelig et al. | 463/6 |
| 5,564,700 | A | * | 10/1996 | Celona | 463/27 |
| 5,570,885 | A | | 11/1996 | Ornsten | |
| 5,580,309 | A | | 12/1996 | Piechowiak et al. | |
| 5,611,535 | A | | 3/1997 | Tiberio | |
| 5,611,730 | A | * | 3/1997 | Weiss | 463/20 |
| 5,645,486 | A | | 7/1997 | Nagao et al. | |
| 5,655,961 | A | | 8/1997 | Acres et al. | 463/27 |
| 5,674,128 | A | | 10/1997 | Holch et al. | |
| 5,702,304 | A | | 12/1997 | Acres et al. | |
| 5,741,183 | A | | 4/1998 | Acres et al. | |
| 5,752,882 | A | | 5/1998 | Acres et al. | |
| 5,761,647 | A | | 6/1998 | Boushy | |
| 5,762,552 | A | | 6/1998 | Vuong et al. | |
| 5,766,076 | A | * | 6/1998 | Pease et al. | 463/27 |
| RE35,864 | E | | 7/1998 | Weingardt | |
| 5,779,545 | A | | 7/1998 | Berg et al. | |
| 5,788,573 | A | | 8/1998 | Baerlocher et al. | |
| 5,800,269 | A | | 9/1998 | Holch et al. | |
| 5,807,172 | A | | 9/1998 | Piechowiak | |
| 5,816,918 | A | | 10/1998 | Kelly et al. | |
| 5,820,459 | A | | 10/1998 | Acres et al. | |
| 5,833,538 | A | | 11/1998 | Weiss | |
| 5,836,817 | A | | 11/1998 | Acres et al. | |
| 5,851,149 | A | | 12/1998 | Xidos et al. | |
| 5,855,515 | A | | 1/1999 | Pease et al. | |
| 6,012,982 | A | | 1/2000 | Piechowiak et al. | |
| 6,048,269 | A | | 4/2000 | Burns et al. | |
| 6,080,062 | A | | 6/2000 | Olson | |
| 6,089,980 | A | | 7/2000 | Gauselmann | |
| 6,146,270 | A | | 11/2000 | Huard et al. | |
| 6,162,122 | A | | 12/2000 | Acres et al. | |
| 6,168,523 | B1 | | 1/2001 | Piechowiak et al. | |
| 6,183,366 | B1 | | 2/2001 | Goldberg et al. | |
| 6,244,958 | B1 | | 6/2001 | Acres | |
| 6,254,483 | B1 | | 7/2001 | Acres | |
| 6,257,981 | B1 | | 7/2001 | Acres et al. | |
| 6,264,557 | B1 | | 7/2001 | Schneier et al. | |
| 6,287,202 | B1 | | 9/2001 | Pascal et al. | |
| RE37,414 | E | | 10/2001 | Harlick | |
| 6,319,125 | B1 | | 11/2001 | Acres | |
| 6,431,983 | B2 | | 8/2002 | Acres | |
| RE37,885 | E | | 10/2002 | Acres et al. | |
| 6,565,434 | B1 | | 5/2003 | Acres | |
| 6,800,030 | B2 | | 10/2004 | Acres | |
| 6,832,958 | B2 | | 12/2004 | Acres et al. | |
| RE38,812 | E | | 10/2005 | Acres et al. | |
| 6,984,173 | B1 | | 1/2006 | Piechowiak et al. | |
| 2001/0049303 | A1 | | 12/2001 | Found et al. | |
| 2001/0055990 | A1 | | 12/2001 | Acres | |
| 2003/0060279 | A1 | | 3/2003 | Torango | |
| 2003/0228904 | A1 | | 12/2003 | Acres et al. | |
| 2005/0032573 | A1 | | 2/2005 | Acres et al. | |
| 2005/0143168 | A1 | | 6/2005 | Torango | |

FOREIGN PATENT DOCUMENTS

| | | |
|---|---|---|
| AU | 524709 | 8/1979 |
| AU | 66683/81 | 1/1981 |
| AU | 542455 | 3/1984 |
| AU | 555905 | 11/1984 |
| AU | 628330 | 11/1989 |
| AU | 649009 | 8/1991 |
| AU | 633469 | 1/1993 |
| AU | 680920 | 8/1995 |
| AU | 707687 | 4/1997 |
| AU | 70247/96 | 4/1997 |
| AU | 709724 | 8/1997 |
| AU | 716299 | 1/1998 |
| AU | 2001100032 | 6/2001 |
| AU | 2001100033 | 6/2001 |
| EP | 0342797 | 11/1989 |
| EP | 0 420 586 | 4/1991 |
| EP | 0 444 932 | 9/1991 |
| GB | 2139390 | 11/1984 |
| GB | 2147773 | 5/1985 |
| GB | 2148135 | 5/1985 |
| GB | 2151054 | 7/1985 |
| GB | 2 153 572 | 8/1985 |
| JP | 7-148307 | 6/1995 |
| WO | WO 94/12256 | 6/1994 |
| WO | WO 95/22811 | 8/1995 |
| WO | WO 95/30944 | 11/1995 |
| WO | WO 96/12262 | 4/1996 |
| WO | WO 96/24421 | 8/1996 |
| WO | WO 97/12338 | 4/1997 |
| WO | WO 97/27568 | 7/1997 |

OTHER PUBLICATIONS

Aristocrat IDS dated Mar. 8, 2005, filed in U.S. Appl. No. 09/462,717, and referring to Surprize gaming machine.

Surprize Gaming Machine Advertisement, Aristocrat Leisure Industries, Australia.

"Surprise Software Specification for MV2030—var 01," Aristocrat Leisure Industries, Australia.

Russell Campbell, The Equipment Manual, Revision 1, Sep. 1990, Computa Game.

Clive Davies, Neil Montgomery, The Software Manual, Revision 3, Jul. 1991, Computa Game Pty Ltd.

Mikohn Inc. Product Catalog, Jan. 1993.

Mikohn Inc. Super Controller Manual, (1989), 207 pgs.

Bueschel, Richard M., "Lemons, Cherries and Bell–Fruit–Gum," Nov. 1995, pp. 1–4, 304–314, Royal Bell Books.

Grips International, "Wide Area Progressive Link System," Feb. 20, 1997.

Grips International, "Integrated Real Time On–Line Slot System—SDI," Feb. 20, 1997.

Grips International, "PEM—Precision Electronic Meter," Feb. 20, 1997.

Grips International, "Player Tracking on Slots," Feb. 20, 1997.

Aristocrat, "Catalogue of Champions," (1990), 4 pgs.

Fast Buck Systems Manual, May 30, 1990, 52 pgs.

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–3, 7–9, 11, 12, 15–18, 22–24, 26, 27 and 30 are cancelled.

Claims 4–6, 10, 13, 19–21 and 25 are determined to be patentable as amended.

Claims 14, 28 and 29, dependent on an amended claim, are determined to be patentable.

New claims 31–52 are added and determined to be patentable.

4. A progressive gaming system [as claimed in claim 1] *comprising:*

*a central computer coupled, at least indirectly, to gaming terminals each of which is coupled to a notification device for indicating the win of a progressive prize;*

*a first plurality of said gaming terminals being eligible for a first progressive prize, based on first contributions from said first plurality of gaming terminals;*

*a second plurality of said gaming terminals being eligible for a second progressive prize, based on second contributions from said second plurality of gaming terminals;*

*said central computer receiving information regarding said first contributions and transmitting information, when said first progressive prize has been won, to indicate a win using said notification device coupled to one of said first plurality of gaming terminals;*

*said central computer receiving information regarding said second contributions and transmitting information, when said second progressive prize has been won, to indicate a win using said notification device coupled to one of said second plurality of gaming terminals;*

*wherein the same said central computer calculates both the amount of said first progressive prize, when said first progressive prize has been won, and the amount of said second progressive prize, when said second progressive prize has been won, and* wherein said central computer stores an indication of the value of at least a first group denomination associated with said first progressive prize, and wherein said information regarding said first contributions indicates integral multiples of said first group denomination*;*

*wherein said central computer also stores an indication of the value of said second group denomination associated with said second progressive prize, and wherein said information regarding said second contributions indicates integral multiples of said second group denomination;*

*wherein for any two of said first plurality of gaming terminals eligible for said first progressive prize, a ratio of an odds of winning said first progressive prize to a wager made towards said first progressive prize for one of the two gaming terminals is in proportion to a ratio of an odds of winning said first progressive prize to a wager made towards said first progressive prize for the other of the two gaming terminals, regardless of the wager amount; and*

*wherein for any two of said second plurality of gaming terminals eligible for said second progressive prize, a ratio of an odds of winning said second progressive prize to a wager made towards said second progressive prize for one of the two gaming terminals is in proportion to a ratio of an odds of winning said second progressive prize to a wager made towards said second progressive prize for the other of the two gaming terminals, regardless of the wager amount,*

*whereby at least one of said first plurality of gaming terminals has a different denomination than said denomination of said other of said first plurality of gaming terminals;*

*said first and second contributions each comprising the amount contributed towards the respective first and second progressive prizes;*

*said first and second group denominations each comprising a denomination of at least one of the gaming terminals in the respective first and second plurality of gaming terminals; and*

*said integral multiples of said first and second group denominations is an integer.*

5. A progressive gaming system [as claimed in claim 1] *comprising:*

*a central computer coupled, at least indirectly, to gaming terminals each of which is coupled to a notification device for indicating the win of a progressive prize;*

*a first plurality of said gaming terminals being eligible for a first progressive prize, based on first contributions from said first plurality of gaming terminals;*

*a second plurality of said gaming terminals being eligible for a second progressive prize, based on second contributions from said second plurality of gaming terminals;*

*said first and second pluralities of gaming terminals each having at least one gaming terminal including a first wager amount that allows eligibility to the first progressive prize and a second wager amount that allows eligibility to the second progressive prize;*

*said central computer receiving information regarding said first contributions and transmitting information, when said first progressive prize has been won, to indicate a win using said notification device coupled to one of said first plurality of gaming terminals;*

*said central computer receiving information regarding said second contributions and transmitting information, when said second progressive prize has been won, to indicate a win using said notification device coupled to one of said second plurality of gaming terminals;*

*wherein the same said central computer calculates both the amount of said first progressive prize, when said first progressive prize has been won, and the amount of said second progressive prize, when said second progressive prize has been won; and* wherein each of said first plurality of gaming terminals requires a minimum wager for participation in a game which is eligible for said first progressive prize and wherein at least one of said first plurality of gaming terminals has a minimum wager different from the minimum wager of at least another of said first plurality of gaming terminals,

*wherein for any two of said first plurality of gaming terminals eligible for said first progressive prize, a ratio of an odds of winning said first progressive prize to a wager made towards said first progressive prize for one of the two gaming terminals is in proportion to a ratio of an odds of winning said first progressive prize to a wager made towards said first progressive prize for the other of the two gaming terminals, regardless of the wager amount; and*

*wherein for any two of said second plurality of gaming terminals eligible for said second progressive prize, a ratio of an odds of winning said second progressive prize to a wager made towards said second progressive prize for one of the two gaming terminals is in proportion to a ratio of an odds of wining said second progressive prize to a wager made towards said second progressive prize for the other of the two gaming terminals, regardless of the wager amount.*

6. A progressive gaming system[, as claimed in claim 1,] *comprising:*

*a central computer coupled, at least indirectly, to gaming terminals each of which is coupled to a notification device for indicating the win of a progressive prize;*

*a first plurality of said gaming terminals being eligible for a first progressive prize, based on first contributions from said first plurality of gaming terminals, at least two of said first plurality of gaming terminals each having a different wager amount which allows eligibility for said first progressive prize;*

*a second plurality of said gaming terminals being eligible for a second progressive prize, based on second contributions from said second plurality of gaming terminals, at least two of said second plurality of gaming terminals each having a different wager amount which allows eligibility for said second progressive prize;*

*said central computer receiving information regarding said first contributions and transmitting information, when said first progressive prize has been won, to indicate a win using said notification device coupled to one of said first plurality of gaming terminals;*

*said central computer receiving information regarding said second contributions and transmitting information, when said second progressive prize has been won, to indicate a win using said notification device coupled to one of said second plurality of gaming terminals;*

*wherein the same said central computer calculates both the amount of said first progressive prize, when said first progressive prize has been won, and the amount of said second progressive prize, when said second progressive prize has been won;* wherein said central computer is configured to retrieve progressive gaming information from a database, wherein said progressive gaming information includes first odds information relating to odds of winning said first progressive prize and second odds information relating to odds of winning said second progressive prize

*wherein for any two of said first plurality of gaming terminals eligible for said first progressive prize, a ratio of an odds of winning said first progressive prize to a wager made towards said first progressive prize for one of the two gaming terminals is in proportion to a ratio of an odds of winning said first progressive prize to a wager made towards said first progressive prize for the other of the two gaming terminals, regardless of the wager amount; and*

*wherein for any two of said second plurality of gaming terminals eligible for said second progressive prize, a ratio of an odds of winning said second progressive prize to a wager made towards said second progressive prize for one of the two gaming terminals is in proportion to a ratio of an odds of winning said second progressive prize to a wager made towards said second progressive prize for the other of the two gaming terminals, regardless of the wager amount.*

10. A progressive gaming system *comprising:* a central computer coupled, at least indirectly, to gaming terminals each of which is coupled to a notification device for indicating the win of a progressive prize;

a first plurality of said gaming terminals being eligible for a first progressive prize, based on first contributions from said first plurality of gaming terminals, *at least two of said first plurality of gaming terminals each having different wager amounts which allow eligibility for said first progressive prize*;

a second plurality of said gaming terminals being eligible for a second progressive prize, based on second contributions from said second plurality of gaming terminals, *at least two of said second plurality of gaming terminals each having different wager amounts which allow eligibility for said second progressive prize*;

said central computer receiving information regarding said first contributions and transmitting information, when said first progressive prize has been won, to indicate a win using said notification device coupled to one of said first plurality of gaming terminals; and said central computer receiving information regarding said second contributions and transmitting information, when said second progressive prize has been won, to indicate a win using said notification device coupled to one of said second plurality of gaming terminals;

wherein said central computer is configured to retrieve progressive gaming information from a database, wherein said progressive gaming information includes first odds information relating to odds of winning said first progressive prize and second odds information relating to odds of winning said second progressive prize;

wherein said central [system] *computer* is configured to perform at least a first check to detect errors in information stored in said database, relating to a progressive game, before said progressive game is first played*;*

*wherein for any two of said first plurality of gaming terminals eligible for said first progressive prize, a ratio of an odds of winning said first progressive prize to a wager made towards said first progressive prize for one of the two gaming terminals is in proportion to a ratio of an odds of winning said first progressive prize to a wager made towards said first progressive prize for the other of the two gaming terminals, regardless of the wager amount; and*

*wherein for any two of said second plurality of gaming terminals eligible for said second progressive prize, a ratio of an odds of winning said second progressive*

*prize to a wager made towards said second progressive prize for one of the two gaming terminals is in proportion to a ratio of an odds of winning said second progressive prize to a wager made towards said second progressive prize for the other of the two gaming terminals, regardless of the wager amount.*

13. A progressive gaming system as claimed in claim 10 wherein each of said first and second pluralities of gaming terminals has an acceptable denomination, said database is used to store game denomination values associated with each of said first and second pluralities of gaming terminals and group denomination values associated with each of said first and second progressive prizes, and wherein said first check is a check to assure the game denomination values associated with each of said first plurality of gaming terminals is equal to or greater than the group denomination value associated with [for] said first progressive prize and the game denomination values associated with each of said second plurality of gaming terminals is equal to or greater than the group denomination value associated with [for] said second progressive prize.

19. A method [as claimed in claim 16 further] *for providing a progressive gaming system implemented using central computer coupled, at least indirectly, to gaming terminals each of which is coupled to a notification device for indicating the win of a progressive prize, the method* comprising:

*receiving, in said central computer, first information indicating contributions towards a first progressive prize from a first plurality of said gaming terminals eligible for said first progressive prize;*

*receiving, in said central computer, second information indicating contributions towards a second progressive prize from a second plurality of said gaming terminals eligible for said second progressive prize;*

*transmitting from said central computer, when said first progressive prize has been won, information for activating at least one notification device coupled to one of said first plurality of gaming terminals;*

*transmitting from said central computer, when said second progressive prize has been won, information for activating at least one notification device coupled to one of said second plurality of gaming terminals,* storing, by said central computer, an indication of the value of at least a first group denomination associated with said first progressive prize, and wherein said information regarding said first contributions indicates integral multiples of said first group denomination*;*

*storing, by said central computer, an indication of the value of a second group denomination associated with said second progressive prize, wherein said information regarding said second contributions indicates integral multiples of said second group denomination;*

*wherein for any two of said first plurality of gaming terminals eligible for said first progressive prize, a ratio of an odds of winning said first progressive prize to a wager made towards said first progressive prize for one of the two gaming terminals is in proportion to a ratio of an odds of winning said first progressive prize to a wager made towards said first progressive prize for the other of the two gaming terminals, regardless of the wager amount; and*

*wherein for any two of said second plurality of gaming terminals eligible for said second progressive prize, a ratio of an odds of winning said second progressive prize to a wager made towards said second progressive prize for one of the two gaming terminals is in proportion to a ratio of an odds of winning said second progressive prize to a wager made towards said second progresive prize for the other of the two gaming terminals, regardless of the wager amount,*

*whereby at least one of said first plurality of gaming terminals has a different denomination than said denomination of said other of said first plurality of gaming terminals;*

*said first and second contributions each comprising the amount contributed towards the respective first and second progressive prizes;*

*said first and second group denominations each comprising a denomination of at least one of the gaming terminals in the respective first and second plurality of gaming terminals; and*

*said integral multiples of said first and second group denominations is an integer.*

20. A method [as claimed in claim 16 wherein each of said] *for providing a progressive gaming system implemented using a central computer coupled, at least indirectly, to gaming terminals each of which is coupled to a notification device for indicating the win of a progressive prize, the method comprising:*

*receiving, in said central computer, first information indicating contributions towards a first progressive prize from a first plurality of said gaming terminals eligible for said first progressive prize;*

*receiving, in said central computer, second information indicating contributions towards a second progressive prize from a second plurality of said gaming terminals eligible for said second progressive prize, said first and second pluralities of gaming terminals each having at least one gaming terminal including a first wager amount that allows eligibility to the first progressive prize and a second different wager amount that allows eligibility to the second progressive prize;*

*transmitting from said central computer, when said first progressive prize has been won, information for activating at least one notification device coupled to one of said first plurality of gaming terminals;*

*transmitting from said central computer, when said second progressive prize has been won, information for activating at least one notification device coupled to one of said second plurality of gaming terminals, and*

*wherein for any two of said first plurality of gaming terminals eligible for said first progressive prize, a ratio of an odds of winning said first progressive prize to a wager made towards said first progressive prize for one of the two gaming terminals is in proportion to a ratio of an odds of winning said first progressive prize to a wager made towards said first progressive prize for the other of the two gaming terminals, regardless of the wager amount;*

*wherein for any two of said second plurality of gaming terminals eligible for said second progressive prize, a ratio of an odds of winning said second progressive prize to a wager made towards said second progressive prize for one of the two gaming terminals is in proportion to a ratio of an odds of winning said second progressive prize to a wager made towards said second progressive prize for the other of the two gaming terminals, regardless of the wager amount, and*

*wherein each of said* first plurality of gaming terminals requires a minimum wager for participation in a game which is eligible for said first progressive prize and wherein at least one of said first plurality of gaming terminals has a minimum wager different from the minimum wager of at least another of said first plurality of gaming terminals.

21. A method[, as claimed in claim 16 further] *for providing a progressive gaming system implemented using a central computer coupled, at least indirectly, to gaming terminals each of which is coupled to a notification device for indicating the win of a progressive prize, the method* comprising:

*receiving, in said central computer, first information indicating contributions towards a first progressive prize from a first plurality of said gaming terminals eligible for said first progressive prize, wherein at least two of said first plurality of gaming terminals each have different wager amounts which allow eligibility for said first progressive prize;*

*receiving, in said central computer, second information indicating contributions towards a second progressive prize from a second plurality of said gaming terminals eligible for said second progressive prize, wherein at least two of said second plurality of gaming terminals each have different wager amounts which allow eligibility for said second progressive prize;*

*transmitting from said central computer, when said first progressive prize has been won, information for activating at least one notification device coupled to one of said first plurality of gaming terminals;*

*transmitting from said central computer, when said second progressive prize has been won, information for activating at least one notification device coupled to one of said second plurality of gaming terminals, and* retrieving, by said central computer, progressive gaming information from a database, wherein said progressive gaming information includes first odds information relating to odds of winning said first progressive prize and second odds information relating to odds of winning said second progressize prize*;*

*wherein for any two of said first plurality of gaming terminals eligible for said first progressive prize, a ratio of an odds of winning said first progressive prize to a wager made towards said first progressive prize for one of the two gaming terminals is in proportion to a ratio of an odds of winning said first progressive prize to a wager made towards said first progressive prize for the other of the two gaming terminals, regardless of the wager amount; and*

*wherein for any two of said second plurality of gaming terminals eligible for said second progressive prize, a ratio of an odds of winning said second progressive prize to a wager made towards said second progressive prize for one of the two gaming terminals is in proportion to a ratio of an odds of winning said second progressive prize to a wager made towards said second progressive prize for the other of the two gaming terminals, regardless of the wager amount.*

25. A method for providing a progressive gaming system implemented using *a* central computer coupled, at least indirectly, to gaming terminals each of which is coupled to a notification device for indicating the win of a progressive prize, the method comprising:

receiving, in said central computer, first information indicating contributions towards a first progressive prize from a first plurality of said gaming terminals eligible for said first progressive prize, *wherein at least two of said first plurality of gaming terminals each have different wager amounts which allow eligibility for said first progressive prize*;

receiving, in said central computer, second information indicating contributions towards a second progressive prize from a second plurality of said gaming terminals eligible for said second progressive prize, *wherein at least two of said second plurality of gaming terminals each have different wager amounts which allow eligibility for said second progressive prize*;

transmitting from said central computer, when said first progressive prize has been won, information for activating at least one notification device coupled to one of said first plurality of gaming terminals;

transmitting from said central computer, when said second progressive prize has been won, information for activating at least one notification device coupled to one of said second plurality of gaming terminals; and performing, in said central system, at least a first check to detect errors in information stored in said database[.] relating to [a] *said first and second* progressive [game] *games*, before said *first and second* progressive [game is] *games are* first played*;*

*wherein said first check verifies that a ratio of an odds of winning said first and second progressive prizes to wagers made towards said first and second progressive prizes is in proportion teach other, regardless of the wager amounts.*

*31. A progressive gaming system comprising:*

*a central computer coupled, at least indirectly, to gaming terminals each of which is coupled to a notification device for indicating the win of a progressive prize;*

*a first plurality of said gaming terminals being eligible for a first progressive prize, based on first contributions from said first plurality of gaming terminals, wherein at least two of said first plurality of gaming terminals each have different wager amounts which allow eligibility for said first progressive prize;*

*a second plurality of said gaming terminals being eligible for a second progressive prize, based on second contributions from said second plurality of gaming terminals, wherein at least two of said second plurality of gaming terminals each have different wager amounts which allow eligibility for said second progressive prize;*

*said first and second pluralities of gaming terminals having at least one gaming terminal in common;*

*said central computer receiving information regarding said first progressive prize including information regarding said first contributions and information regarding when said first progressive prize has been won;*

*said central computer receiving information regarding said second progressive prize including information regarding said second contributions and information regarding when said second progressive prize has been won;*

*said central computer calculating amounts of said first progressive prize based on said information received from said first plurality of gaming terminals;*

*said central computer calculating amounts of said second progressive prize based on said information received from said second plurality of gaming terminals;*

*said central computer transmitting information, when said first progressive prize has been won, to indicate a win using said notification device coupled to one of said first plurality of gaming terminals; and*

*said central computer transmitting information, when said second progressive prize has been won, to indicate a win using said notification device coupled to one of said second plurality of gaming terminals,*

*wherein for any two of said first plurality of gaming terminals eligible for said first progressive prize, a ratio of an odds of winning said first progressive prize to a wager made towards said first progressive prize for one of the two gaming terminals is in proportion to a ratio of an odds of winning said first progressive prize to a wager made towards said first progressive prize for the other of the two gaming terminals, regardless of the wager amount; and*

*wherein for any two of said second plurality of gaming terminals eligible for said second progressive prize, a ratio of an odds of winning said second progressive prize to a wager made towards said second progressive prize for one of the two gaming terminals is in proportion to a ratio of an odds of winning said second progressive prize to a wager made towards said second progressive prize for the other of the two gaming terminals, regardless of the wager amount.*

*32. The progressive gaming system of claim 31 wherein said first and second pluralities of gaming terminals have a plurality of gaming terminals in common.*

*33. The progressive gaming system of claim 31 wherein said first progressive prize is won based at least partially on a randomly generated event.*

*34. The progressive gaming system of claim 31 wherein said first progressive prize is won independent of any result of play in any of said first plurality of gaming terminals.*

*35. The progressive gaming system of claim 31 wherein said notification device comprises a single notification device, and wherein said single notification device is coupled to both said first and second plurality of gaming terminals.*

*36. A progressive gaming system comprising:*

*a central computer coupled, at least indirectly, to gaming terminals each of which is coupled to a notification device for indicating the win of a progressive prize;*

*a first plurality of said gaming terminals being eligible for a first progressive prize, based on first contributions from said first plurality of gaming terminals, wherein at least two of said first plurality of gaming terminals each have different wager amounts which allow eligibility for said first progressive prize;*

*a second plurality of said gaming terminals being eligible for a second progressive prize, based on second contributions from said second plurality of gaming terminals, wherein at least two of said second plurality of gaming terminals each have different wager amounts which allow eligibility for said second progressive prize;*

*said central computer receiving information regarding said first contributions and transmitting information, when said first progressive prize has been won, to indicate a win using said notification device coupled to one of said first plurality of gaming terminals; and*

*said central computer receiving information regarding said second contributions and transmitting information, when said second progressive prize has been won, to indicate a win using said notification device coupled to one of said second plurality of gaming terminals;*

*wherein said central computer is configured to retrieve progressive gaming information from a database, wherein said progressive gaming information includes first odds information relating to odds of winning said first progressive prize and second odds information relating to odds of winning said second progressive prize;*

*wherein said central system is configured to perform at least a first check to detect errors in information stored in said database, relating to at least one of said first and second progressive games, before said first and second progressive games are first played; and*

*wherein for each of said first plurality of gaming terminals eligible for said first progressive prize, said database is used to store at least an expected number of coins to be played between wins of the first progressive prize, a coins required value associated with each of said first plurality of gaming terminals, and a win cycle value, and wherein said first check is a check to assure that the coins to be played value divided by the product of the coins required value times the win cycle value is an integer; and*

*wherein for each of said second plurality of gaming terminals eligible for said second progressive prize, said database is used to store at least an expected number of coins to be played value between wins of the second progressive prize, a coins required value associated with each of said second plurality of gaming terminals, and a win cycle value, and wherein said first check is a check to assume that the coins to be played value divided by the product of the coins required value times the win cycle value is an integer,*

*the win cycle value respectively associated with each of the first and second pluralities of gaming terminals being the number of handle pulls expected before a win of the first or second progressive prize occurs.*

*37. A progressive gaming system comprising:*

*a central computer coupled, at least indirectly, to gaming terminals each of which is coupled to a notification device for indicating the win of a progressive prize;*

*a first plurality of said gaming terminals being eligible for a first progressive prize, based on first contributions from said first plurality of gaming terminals;*

*a second plurality of said gaming terminals being eligible for a second progressive prize, based on second contributions from said second plurality of gaming terminals;*

*said central computer receiving information regarding said first contributions and transmitting information, when said first progressive prize has been won, to indicate a win using said notification device coupled to one of said first plurality of gaming terminals; and*

*said central computer receiving information regarding said second contributions and transmitting information, when said second progressive prize has been won, to indicate a win using said notification device coupled to one of said second plurality of gaming terminals;*

*wherein said central computer is configured to retrieve progressive gaming information from a database, wherein said progressive gaming information includes first odds information relating to odds of winning said first progressive prize and second odds information relating to odds of winning said second progressive prize;*

*wherein said central system is configured to perform at least a first check to detect errors in information stored in said database, relating to at least one of said first and second progressive games, before said first and second progressive games are first played;*

*wherein for each of said first and second pluralities of gaming terminals eligible for said first and second progressive prizes, said database is used to store at least an expected number of coins to be played value between wins of the first and second progressive prizes based on prize type, a coins required value associated with each of said first and second pluralities of gaming terminals based on game type, a win cycle value based on game type, a group denomination value and a game denomination value and wherein said first check is a check to assure that an integer produced by multiplying a ratio defined by the coins to be played value based on prize type divided by the coins required value based on game type multiplied by the win cycle value based on game type, by the group denomination value equals the game denomination value,*

*the group denomination value associated with said first and second pluralities of gaming terminals being the lowest value coin in each of said first and second pluralities of gaming terminals that can initiate play*

*the game denomination value associated with each of said first and second pluralities of gaming terminals being the lowest value of coin which can be accepted by each of said first and second pluralities of gaming terminals to initiate any play of each of said first and second pluralities of gaming terminals, and*

*the win cycle value respectively associated with each of the first and second pluralities of gaming terminals being the number of handle pulls expected before a win of the first or second progressive prize occurs.*

*38. A method for providing a progressive gaming system implemented using a central computer coupled, at least indirectly, to gaming terminals each of which is coupled to a notification device for indicating the win of a progressive prize, the method comprising:*

*receiving, in said central computer, first information indicating contributions towards a first progressive prize from a first plurality of said gaming terminals eligible for said first progressive prize;*

*receiving, in said central computer, second information indicating contributions towards a second progressive prize from a second plurality of said gaming terminals eligible for said second progressive prize;*

*transmitting from said central computer, when said first progressive prize has been won, information for activating at least one notification device coupled to one of said first plurality of gaming terminals;*

*transmitting from said central computer, when said second progressive prize has been won, information for activating at least one notification device coupled to one of said second plurality of gaming terminals;*

*performing, in said central computer, at least a first check to detect errors in information stored in said database, relating to a progressive game, before said progressive game is first played;*

*wherein for each of said first plurality of gaming terminals eligible for said first progressive prize, said database is used to store at least an expected number of coins to be played between wins of the first progressive prize based on prize type, a coins required value associated with each of said first plurality of gaming terminals based on game type and a win cycle value based on game type and wherein said first check is a check to assure that the coins to be played value divided by the product of the coins required value times the win cycle value is an integer; and*

*wherein for each of said second plurality of gaming terminals eligible for said second progressive prize, said database is used to store at least an expected number of coins to be played value betweens of the second progressive prize based on prize type, a coins required value associated with each of said second plurality of gaming terminals based on game type and a win cycle value based on game type and wherein said first check is a check to assure that the coins to be played value divided by the product of the coins required value times the win cycle value is an integer;*

*the win cycle value respectively associated with each of the first and second pluralities of gaming terminals being the number of handle pulls expected before a win of the first or second progressive prize occurs.*

*39. A method for providing a progressive gaming system implemented using a central computer coupled, at least indirectly, to gaming terminals each of which is coupled to a notification device for indicating the win of a progressive prize, the method comprising:*

*receiving, in said central computer, first information indicating contributions towards a first progressive prize from a first plurality of said gaming terminals eligible for said first progressive prize;*

*receiving, in said central computer, second information indicating contributions towards a second progressive prize from a second plurality of said gaming terminals eligible for said second progressive prize;*

*transmitting from said central computer, when said first progressive prize has been won, information for activating at least one notification device coupled to one of said first plurality of gaming terminals;*

*transmitting from said central computer, when said second progressive prize has been won, information for activating at least one notification device coupled to one of said second plurality of gaming terminals;*

*performing, in said central conputer, at least a first check to detect errors in information stored in said database, relating to at least one of said first and second progressive games, before said first and second progressive games are played; and*

*wherein for each of said first and second pluralities of gaming terminals eligible for said first and second progressive prizes, said database is used to store at least an expected number of coins to be played value between wins of the first and second progressive prizes based on prize type, a coins required value associated with each of said first and second pluralities of gaming terminals based on game type, a win cycle value based on game type, a group denomination value and a game denomination value and wherein said first check is a check to assure that an integer produced by multiplying a ratio defined by the coins to be played value based on prize type divided by the coins required value based on game type multipled by the win cycle value based on game type by the group denomination value equals the game denomination value,*

*the group denomination value associated with said first and second pluralities of gaming terminals being the lowest value coin in each of said first and second pluralities of gaming terminals that can initiate play*

*the game denomination value associated with each of said first and second pluralities of gaming terminals being the lowet value of coin which can be accepted by each of said first and second pluralities of gaming terminals to initiate any play of each of said first and second pluralities of gaming terminals, and*

*the win cycle value respectively associated with each of the first and second pluralities of gaming terminals being the number of handle pulls expected before a win of the first or second progressive prize occurs.*

*40. A progressive gaming system comprising:*

*a central computer coupled, at least indirectly, to gaming terminals each of which is coupled to a notification device for indicating the win of a progressive prize;*

*a first plurality of said gaming terminals being eligible for a first progressive prize, based on first contributions from said first plurality of gaming terminals, at least two of said first plurality of gaming terminals each having different wager amounts which allow eligibility for said first progressive prize;*

*a second plurality of said gaming terminals being eligible for a second progressive prize, based on second contributions from said second plurality of gaming terminals, at least two of said second plurality of gaming terminals each having different wager amounts which allow eligibility for said second progressive prize, wherein said central computer provides the first and second progressive prizes at the same time;*

*said central computer receiving information regarding said first contributions and transmitting information, when said first progressive prize has been won, to indicate a win using said notification device coupled to one of said first plurality of gaming terminals;*

*said central computer receiving information regarding said second contributions and transmitting information, when said second progressive prize has been won, to indicate a win using said notification device coupled to one of said second plurality of gaming terminals;*

*wherein the same said central computer calculates both the amount of said first progressive prize, when said first progressive prize has been won, and the amount of said second progressive prize, when said second progressive prize has been won;*

*wherein for any two of said first plurality of gaming terminals eligible for said first progressive prize, a ratio of an odds of winning said first progressive prize to a wager made towards said first progressive prize for one of the two gaming terminals is in proportion to a ratio of an odds of winning said first progressive prize to a wager made towards said first progressive prize for the other of the two gaming terminals, regardless of the wager amount; and*

*wherein for any two of said second plurality of gaming terminals eligible for said second progressive prize, a ratio of an odds of winning said second progressive prize to a wager made towards said second progressive prize for one of the two gaming terminals is in proportion to a ratio of an odds of winning said second progressive prize to a wager made towards said second progressive prize for the other of the two gaming terminals, regardless of the wager amount.*

*41. A progressive gaming system comprising:*

*a central computer coupled, at least indirectly, to gaming terminals each of which is coupled to a notification device for indicating the win of a progressive prize;*

*a first plurality of said gaming terminals being eligible for a first progressive prize, based on first contributions from said first plurality of gaming terminals;*

*a second plurality of said gaming terminals being eligible for a second progressive prize, based on second contributions from said second plurality of gaming terminals, said first and second pluralities of said gaming terminals having at least one gaming terminal in common but not all of the gaming terminals in common;*

*said central computer receiving information regarding said first contributions and transmitting information, when said first progressive prize has been won, to indicate a win using said notification device coupled to one of said first plurality of gaming terminals;*

*said central computer receiving information regarding said second contributions and transmitting information, when said second progressive prize has been won, to indicate a win using said notification device coupled to one of said second plurality of gaming terminals;*

*wherein the same said central computer calculates both the amount of said first progressive prizes, when said first progressive prize has been won, and the amount of said second progressive prize, when said second progressive prize has been won;*

*wherein said central computer stores an indication of the value of at least a first group denomination associated with said first progressive prize, and wherein said information regarding said first contributions indicates integral multiples of said first group denomination;*

*wherein for any two of said first plurality of gaming terminals eligible for said first progressive prize, a ratio of an odds of winning said first progressive prize to a wager made towards said first progressive prize for one of the two gaming terminals is in proportion to a ratio of an odds of winning said first progressive prize to a wager made towards said first progressive prize for the other of the two gaming terminals, regardless of the wager amount; and*

*wherein for any two of said second plurality of gaming terminals eligible for said second progressive prize, a ratio of an odds of winning said second progressive prize to a wager made towards said second progressive prize for one of the two gaming terminals is in proportion to a ratio of an odds of winning said second progressive prize to a wager made towards said second progressive prize for the other of the two gaming terminals, regardless of the wager amount.*

*42. A progressive gaming system comprising:*

*a central computer coupled, at least indirectly, to gaming terminals each of which is coupled to a notification device for indicating the win of a progressive prize;*

*a first plurality of said gaming terminals being eligible for a first progressive prize, based on first contributions from said first plurality of gaming terminals;*

*a second plurality of said gaming terminals being eligible for a second progressive prize, based on second contributions from said second plurality of gaming terminals;*

*said first and second pluralities of gaming terminals having at least one gaming terminal in common;*

*said central computer receiving information regarding said first contributions and transmitting information, when said first progressive prize has been won, to indicate a win using said notification device coupled to one of said first plurality of gaming terminals; and*

*said central computer receiving information regarding said second contributions and transmitting information, when said second progressive prize has been won, to indicate a win using said notification device coupled to one of said second plurality of gaming terminals;*

*wherein the same said central computer calculates both the amount of said first progressive prize, when said first progressive prize has been won, and the amount of said second progressive prize, when said second progressive prize has been won;*

*wherein for each of said first plurality of gaming terminals eligible for said first progressive prize, a first number of coins on average between wins of said first progressive prize divided by the product of a first minimum number*

*of coins per game initiation required to be eligible for said first progressive prize and a first average number of game initiations between consecutive wins of said first progressive prize associated with each of said first plurality of gaming terminals is an integer; and*

*wherein for each of said second plurality of gaming terminals eligible for said second progressive prize, a second number of coins on average between wins of said second progressive prize divided by the product of a second minimum number of coins per game initiation required to be eligible for said second progressive prize and a second average number of game initiations between consecutive wins of said second progressive prize associated with each of said second plurality of gaming terminals is an integer.*

*43. A progressive gaming system comprising:*

*a central computer coupled, at least indirectly, to gaming terminals each of which is coupled to a notification device for indicating the win of a progressive prize;*

*a first plurality of said gaming terminals being eligible for a first progressive prize, based on first contributions from said first plurality of gaming terminals, at least two of said first plurality of gaming terminals each having different wager amounts which allow eligibility for said first progressive prize;*

*a second plurality of said gaming terminals being eligible for a second progressive prize, based on second contributions from said second plurality of gaming terminals, at least two of said second plurality of gaming terminals each having different wager amounts which allow eligibility for said second progressive prize;*

*said first and second pluralities of gaming terminals having at least one gaming terminal in common;*

*said central computer receiving information regarding said first contributions and transmitting information, when said first progressive prize has been won, to indicate a win using said notification device coupled to one of said first plurality of gaming terminals; and*

*said central computer receiving information regarding said second contributions and transmitting information, when said second progressive prize has been won, to indicate a win using said notification device coupled to one of said second plurality of gaming terminals;*

*wherein the same said central computer calculates both the amount of said first progressive prize, when said first progressive prize has been won, and the amount of said second progressive prize, when said second progressive prize has been won;*

*wherein for any two of said first plurality of gaming terminals eligible for said first progressive prize, a ratio of an odds of winning said first progressive prize to a wager made towards said first progressive prize for one of the two gaming terminals is in proportion to a ratio of an odds of winning said first progressive prize to a wager made towards said first progressive prize for the other of the two gaming terminals, regardless of the wager amount; and*

*wherein for any two of said second plurality of gaming terminals eligible for said second progressive prize, a ratio of an odds of winning said second progressive prize to a wager made towards, said second progressive prize for one of the two gaming terminals is in proportion to a ratio of an odds of winning said second progressive prize to a wager made towards said second progressive prize for the other of the two gaming terminals, regardless of the wager amount.*

*44. The progressive gaming system of claim 43, wherein each of said first plurality of gaming terminals has at least two different wager amounts which allow eligibility for said first progressive prize.*

*45. The progressive gaming system of claim 43, wherein each of said second plurality of gaming terminals has at least two different wager amounts which allow eligibility for said first progressive prize.*

*46. A progressive gaming system comprising:*

*a central computer coupled, at least indirectly, to gaming terminals each of which is coupled to a notification device for indicating the win of a progressive prize;*

*a first plurality of said gaming terminals being eligible for a first progressive prize, based on first contributions from said first plurality of gaming terminals;*

*a second plurality of said gaming terminals being eligible for a second progressive prize, based on second contributions from said second plurality of gaming terminals;*

*said first and second pluralities of gaming terminals having at least one gaming terminal in common, said at least one common gaming terminal having a first wager amount that allows eligibility to the first progressive prize and a second different wager amount that allows eligibility to the second progressive prize;*

*said central computer receiving information regarding said first contributions and transmitting information, when said first progressive prize has been won, to indicate a win using said notification device coupled to one of said first plurality of gaming terminals; and*

*said central computer receiving information regarding said second contributions and transmitting information, when said second progressive prize has been won, to indicate a win using said notification device coupled to one of said second plurality of gaming terminals;*

*wherein the same said central computer calculates both the amount of said first progressive prize, when said first progressive prize has been won, and the amount of said second progressive prize, when said second progressive prize has been won.*

*47. The progressive gaming system of claim 46, wherein the first wager amount also allows eligibility to the second progressive prize.*

*48. The progressive gaming system of claim 46, wherein the second wager amount also allows eligibility to the first progressive prize.*

*49. The progressive gaming system of claim 5, wherein the first wager amount also allows eligibility to the second progressive prize.*

*50. The progressive gaming system of claim 5, wherein the second wager amount also allows eligibility to the first progressive prize.*

*51. The progressive gaming system of claim 6, wherein each of said first plurality of gaming terminals has at least two different wager amounts which allow eligibility for said first progressive prize.*

*52. The progressive gaming system of claim 6, wherein each of said second plurality of gaming terminals has at least two different wager amounts which allow eligibility for said first progressive prize.*

* * * * *